US010479599B2

(12) United States Patent
Dunlap et al.

(10) Patent No.: US 10,479,599 B2
(45) Date of Patent: Nov. 19, 2019

(54) INDUSTRIAL BAG LIFT LOOP ASSEMBLY

(71) Applicant: AMERIGLOBE, LLC, Lafayette, LA (US)

(72) Inventors: Clifford Dunlap, Baton Rouge, LA (US); Daniel R. Schnaars, Sr., Lafayette, LA (US)

(73) Assignee: AMERIGLOBE, LLC, Lafayette, LA (US)

( * ) Notice: Subject to any disclaimer, the term of this patent is extended or adjusted under 35 U.S.C. 154(b) by 0 days.

(21) Appl. No.: 15/383,841

(22) Filed: Dec. 19, 2016

(65) Prior Publication Data

US 2018/0118451 A1 May 3, 2018

Related U.S. Application Data

(60) Provisional application No. 62/269,087, filed on Dec. 17, 2015, provisional application No. 62/419,317, filed on Nov. 8, 2016.

(51) Int. Cl.
*B65D 88/16* (2006.01)

(52) U.S. Cl.
CPC ..... *B65D 88/1681* (2013.01); *B65D 88/1668* (2013.01)

(58) Field of Classification Search
CPC .. B65D 88/1681; B65D 29/00; B65D 33/105; B65D 88/1687; B65D 88/16; B65D 88/1612; B65D 88/1668
USPC ..... 383/16, 20, 22, 24
See application file for complete search history.

(56) References Cited

U.S. PATENT DOCUMENTS 4,211,266 A 7/1980 Massey
4,364,424 A 12/1982 Nattrass
4,479,243 A * 10/1984 Derby ..... B31D 1/06 383/109
4,480,766 A * 11/1984 Platt ..... B65D 88/1681 222/105

(Continued)

FOREIGN PATENT DOCUMENTS

CN 103600936 A * 2/2014
CN 203601811 U * 5/2014

(Continued)

OTHER PUBLICATIONS

Machine translation of the description of JP 06001389 A.*

(Continued)

*Primary Examiner* — Jes F Pascua
(74) *Attorney, Agent, or Firm* — Garvey, Smith & Nehrbass, Patent Attorneys, L.L.C.; Julia M. FitzPatrick; Gregory C. Smith

(57) ABSTRACT

A lifting assembly and method for a flexible bag includes one or more lift members, wherein each lift member is coupled to a layer of material, e.g., a fabric layer. The fabric layer can be coupled to a flexible bag wherein the fabric layer is an intermediate layer between the lift member and the flexible bag. The fabric layer can be heat fused or otherwise coupled to a bag without stitching or sewing, which eliminates the creation of sew or stitch holes that breach a containment area of the bag and which can weaken the bag fabric. The one or more lift members, however, can be sewn or stitched to one or more intermediate layers.

58 Claims, 14 Drawing Sheets

(56) References Cited

U.S. PATENT DOCUMENTS

| | | | | | |
|---|---|---|---|---|---|
| 4,781,473 | A * | 11/1988 | LaFleur | B65D 88/1681 | 383/16 |
| 4,781,475 | A * | 11/1988 | LaFleur | B65D 88/1612 | 383/119 |
| 4,822,179 | A * | 4/1989 | Nattrass | B65D 88/1681 | 383/117 |
| 4,865,218 | A | 9/1989 | Derby et al. | | |
| 5,536,086 | A | 7/1996 | Nattrass | | |
| 5,695,598 | A | 12/1997 | Groshens et al. | | |
| 5,823,683 | A | 10/1998 | Antonacci et al. | | |
| 6,063,418 | A * | 5/2000 | Sugimoto | A23B 9/18 | 383/111 |
| 6,076,702 | A | 6/2000 | Hoffmann et al. | | |
| 6,305,845 | B1 | 10/2001 | Navin | | |
| 6,374,579 | B1 | 4/2002 | Muller | | |
| 6,935,782 | B2 | 8/2005 | Cholsaipant | | |
| 7,276,269 | B2 | 10/2007 | Kraimer et al. | | |
| 8,297,840 | B2 | 10/2012 | Jansen | | |
| 8,562,214 | B2 * | 10/2013 | Dozier | A45C 13/002 | 224/404 |
| 2008/0115458 | A1 | 5/2008 | Funaki et al. | | |
| 2008/0176609 | A1 | 7/2008 | Chereau et al. | | |
| 2009/0260324 | A1 | 10/2009 | Funaki et al. | | |
| 2010/0209025 | A1 | 8/2010 | Futase | | |
| 2011/0019942 | A1 | 1/2011 | Piraneo | | |
| 2011/0085749 | A1 | 4/2011 | Frei et al. | | |
| 2011/0142378 | A1 * | 6/2011 | Samadijavan | B65D 88/1612 | 383/117 |
| 2011/0206300 | A1 | 8/2011 | Koesters et al. | | |
| 2012/0227363 | A1 | 9/2012 | Nussbaum | | |
| 2012/0314979 | A1 | 12/2012 | Heininga | | |
| 2013/0202231 | A1 | 8/2013 | Nowak et al. | | |
| 2013/0209002 | A1 | 8/2013 | Bazbaz | | |
| 2014/0360669 | A1 * | 12/2014 | Schnaars, Sr. | B29C 65/02 | 156/334 |
| 2014/0363106 | A1 * | 12/2014 | Schnaars, Sr. | A41H 43/04 | 383/107 |
| 2018/0050863 | A1 * | 2/2018 | Dunlap | B65D 88/1668 | |
| 2018/0126661 | A1 * | 5/2018 | Dunlap | B29C 65/18 | |

FOREIGN PATENT DOCUMENTS

| | | | | |
|---|---|---|---|---|
| EP | 0342012 | A2 * | 11/1989 | |
| EP | 1298075 | A1 | 4/2003 | |
| EP | 2570365 | | 3/2013 | |
| GB | 1604213 | | 12/1981 | |
| GB | 2429198 | A * | 2/2007 | B65D 88/1687 |
| JP | 06001389 | A * | 1/1994 | B65D 88/1681 |
| JP | h061389 | A | 1/1994 | |
| SU | 1533636 | | 1/1990 | |
| WO | 1998/011291 | | 3/1998 | |
| WO | 2003/032763 | | 4/2003 | |
| WO | 2012/121716 | | 9/2012 | |

OTHER PUBLICATIONS

Machine translation of CN-103600936-A.*

Machine translation of CN-203601811-U.*

PCT International Search Report and the Written Opinion of the Searching Authority for International Application No. PCT/US2014/041154 (dated Nov. 13, 2014).

PCT International Search Report and the Written Opinion of the Searching Authority of International Application No. PCT/US2014/041155 (dated Sep. 30, 2014).

PCT International Search Report and Written Opinion for international patent application serial No. PCT/US17/67393 (dated Apr. 26, 2018).

* cited by examiner

INDUSTRIAL BAG LIFT LOOP ASSEMBLY

CROSS-REFERENCE TO RELATED APPLICATIONS

Priority to and/or the benefit of U.S. Provisional Patent Application Ser. No. 62/269,087, filed 17 Dec. 2015, which is hereby incorporated herein by reference, is hereby claimed.

Priority to and/or the benefit of U.S. Provisional Patent Application Ser. No. 62/419,317, filed 8 Nov. 2016, which is hereby incorporated herein by reference, is hereby claimed.

This application is related to U.S. patent application Ser. No. 15/345,452, filed on 7 Nov. 2016, which claims the benefit of and/or priority to U.S. Provisional Patent Application Ser. No. 62/252,270, filed on Nov. 6, 2015 and U.S. Provisional Patent Application Ser. No. 62/269,087, filed 17 Dec. 2015, each of which is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a lifting assembly including a lift loop or strap assembly provided for a bulk bag. More particularly, the present invention relates to a lift loop that is connected, such as by sewing, to a fabric patch. The patch, with the connected lift loop, can then be separately heat fused or sealed, or otherwise adhered, to the bulk bag body. Consequently, the fabric patch is an intermediate layer between the lift loop and the bulk bag body, wherein the patch connection to the lift loop preferably includes sewing and the patch connection to the bag body preferably includes heat fusion or adhesive or adhering without sewing.

2. General Background of the Invention

Many industries exist in which large quantities of materials or products must be contained and transported. Such materials or products can be free-flowing, making it necessary to fully support the entire volume of such materials or products. Thus, industries that deal with storing and transporting dry, flowable products such as sand, fertilizer, granules of plastic, powdered chemicals, carbon black, grains and food products use what are known as flexible intermediate bulk containers, also known as bulk bags, industrial bags, or big bags. The bags are generally made from flexible fabric, typically woven polypropylene or polyethylene. The bags are generally assembled from multiple pieces of flexible fabric, sewn together at stitched joints. However, some bags are heat fused at the seams instead of stitched, and reference is made to patent application publications WO2014/197728, US 2014/0363106, WO2014/197727, and US2014/0360669, which are hereby incorporated herein, for further detail. At some point during use of a bulk bag, the contained material must be lifted via the bulk bag, such as during custody transfer or discharge of the contained material from the bag. Thus, lift loops, straps, or other members are provided on the bulk bag, which can enable and/or facilitate movement of, lifting of, and transport of a bulk bag.

In the prior art, the attachment of lift loops involves a lot of stitching in select areas of the fabrics. This amount of stitching to allow the bag to be safely picked up has the effect of weakening this critical part of the fabric, which is usually in a containment area of a bag, e.g., along one or more sidewalls. Therefore, the prior art is prone to increasing the number of yarns or stitches in the loop attachment area either by process in the weaving or by folding the fabric over at this lift loop attachment point to place more fabric under the stitches to create safe or safer lifting capacity. For example, in the prior art, one of the most common methods of attaching lift loops to bulk bags uses sewing machines to attach loops to bags using a zigzag pattern of stitching that includes 56 inches of stitches for each of two legs of each loop. This totals 112 inches of stitching that generally has 3 stitches per inch. This means that the sewing machine punctures the fabric 336 times. Each puncture weakens the fabrics original strength thus lowering the strength performance of the fabric. Testing has shown that the seam generated by zigzag stitching lowers the final strength of materials by 37%.

The lifting assembly and method of the present invention eliminates the need for stitching lift loops directly to bag fabric, and eliminates a need for stitching of lift loops in a containment area of a bag. It also thus, eliminates the need for extra yarns or stitching in lift attachment areas as described above. In one or more embodiments of the present invention, a lifting assembly eliminates the stitching of the loops to the bag, e.g., by replacing the 4 stitching methods used in the prior art with a heat fused bond or joint that provides about 90% or more of the original fabric strength in the bonded condition.

In the prior art bags with stitched lift loops, for example, if a bag was improperly handled by less than all four lift loops, the lift loops can tear away from the bag by pulling and breaking portions of the side wall from the bag. This causes large holes in the bulk bag product containment area allowing the product to spill out of the bag and/or contamination to enter the bag. This often causes the loss of the product that was being transported in the bulk bag. If the product was considered to be hazardous, then a spill containment action would be needed. Additionally persons handling the bulk bag, or persons near a bulk bag that had the lift loops fail could be seriously harmed or injured.

BRIEF SUMMARY OF THE INVENTION

The apparatus and method of the present invention includes a lifting assembly for a flexible bag, e.g., a bulk bag, various embodiments of which can carry weights in the range of 500 to 5,000 pounds, or weights anywhere therebetween, and sometimes over 5,000 pounds. A lifting assembly includes one or more lift members, wherein each lift member is preferably coupled to a layer of material, e.g., a fabric layer. The fabric layer can be coupled to a flexible bag wherein the fabric layer is preferably an intermediate layer between the lift member and the flexible bag fabric. The fabric layer can be heat fused or otherwise coupled to the bag without stitching or sewing, which eliminates the creation of sew or stitch holes that can breach a containment area of the bag and which can weaken the bag fabric. In preferred embodiments, a lift member, however, is sewn or stitched to the intermediate fabric layer before the intermediate fabric layer is coupled to the bag fabric.

Various embodiments of the present invention solve problems in the prior art with stitched lift loops that are sewn to a fabric bag, by eliminating the need to reinforce the part of the bag to which the lifting loops are sewn, e.g., as is done in the prior art methods as described above. The method and apparatus of the present invention eliminate the need to stitch lift loops directly to bag fabric and thus eliminate weakening of the bag associated with stitching lift loops directly to the bag fabric. In one or more embodiments of the present invention, a lifting assembly eliminates the stitching of the loops to the bag, e.g., by placing the stitching used in the prior art onto an intermediate layer of fabric and creating a heat fused bond between the layer of fabric and the bag fabric that provides about 90% or more of the original fabric strength in the bonded condition.

Another advantage provided by the apparatus and method of the present invention is an additional safeguard provided when handling bulk bags filled with bulk material to both the product within the bag and persons handling the bag. As discussed above, in the prior art, if a bag with lift loops stitched or sewn directly to bag fabric is improperly handled, e.g., by less than all four lift loops, the lift loops often tear away from the bag by pulling and breaking portions of the side wall from the bag. This causes large holes in the bulk bag product containment area allowing the product to spill out of the bag and/or contamination to enter the bag. This often causes the loss of the product that was being transported in the bulk bag. If the product was considered to be hazardous, then a spill containment action would be needed, and persons exposed to the materials that were contained within the bag could be harmed. In one or more preferred embodiments of the present invention, this problem is solved by adding the lift loops to the bulk bag on a separate piece of fabric, wherein the separate piece of fabric is coupled to the bag in a manner in which it can tear away from the bag without damaging the bag, e.g., given any improper handling of the bag. Preferably the separate piece of fabric or material is coupled to the bag so that if the coupler, e.g., a heat fused joint, fails the bag fabric to which the layer of material is coupled is undamaged and the product remains safely contained within the bag with no leakage. Additionally, when a lift loop is sewn to the separate piece of fabric, even if the sewn connection to the separate piece of fabric tears or breaks or creates a hole in the separate piece of fabric, the bag fabric itself, e.g., fabric in a bulk bag product containment area, e.g., of one or more bag side walls, is not harmed or damaged.

Another novel feature of the present invention is the ability to replace the thick prior art lifting loops (e.g., prior art loops of heavy, thicker polypropylene material that is thicker than the bag fabric, which have to be attached through sewing in the prior art), with loops made of the same material as the bag fabric. In various embodiments of the method and apparatus, lift loops are made of the same material as the bag fabric, e.g., polypropylene fabric (e.g., 2 or 3 ounce polypropylene fabric), or polyethylene fabric that can be used for bulk bags, for forming the lift loops or members.

Additionally, by eliminating the sewing or stitching of lift loops, the bag becomes more amenable to recycling. The lift loops that are often sewn in the prior art bags contain polyester stitching threads which are considered to be a form of contamination in the recycling effort for FIBCs. With the present invention, patches may contain sewn lift loops, wherein the patches are heat fused to a bag, for example, but the patches can be removed from the bag by peeling the patch off and breaking the heat fused joint or coupler prior to sending the bags for recycling. Or in one or more version of the present inventions, fabric can be bonded to the product containment bag that form lift loops without sewing an added belting of heavy thick woven polypropylene.

Another issue solved by lifting assemblies of the present invention is strengthening of the failure point experienced in one and two loop design bags. These designs are well known in the art and have been considered the most efficient bag design in the market. Since it uses all the vertical fibers in the bag body to securely lift the weight, this design often uses a lighter weight of fabric than traditional four loop bags. However, even this efficient design is hampered by the loss of strength in the sewn seam area in the prior art. The present invention, by strengthening the seam strength, e.g., with heat fused joints instead of stitched seams, is able to lower the overall fabric strength even more and achieve similar lifting safety.

Another issue resolved by the apparatus and method of the present invention, e.g., when used with a stitchless bulk bag with all heat fused joints for example, is the ability to eliminate a liner needed to secure the product in one and two lift loop bags, and in four lift loop bags. Given the elimination of stitching holes left by the stitching process, there is little need for liner protection against sifting and contamination. Such a stitchless bag is relatively airtight. Due to the highly efficient bonding strength of the stitchless bag invention, e.g., when a bag is formed with all heat fused joints, and/or no stitched joints in a containment area of the bag, the liner can be replaced with a spouted top, for example. This is desirable as the liner often poses problems during product discharge in the prior art. Since the liner is used for product protection from water, a stitchless design with a fully enclosed top spout can adequately protect the product without a liner. Prior art sewn bags including those with stitched lift loops, continually puncture the fabric and the moisture barrier and further, as stated above, weaken the fabric as well.

In various embodiments, a flexible bag comprises a body including a side wall; and a lift loop assembly comprising a lift loop sewn to a patch; wherein the patch is heat sealed or adhered to the body side wall such that the patch is an intermediate layer between the lift loop and the body side wall.

In various embodiments, the patch heat seal extends at least one inch above a sewn area between the lift loop and the patch.

In various embodiments, a patch is heat sealed or adhered to a body side wall and a lift loop sewn to the patch such that the lift loop is not sewn to the body side wall.

In various embodiments, a lift member assembly for a flexible bag comprises a lift member coupled to a fabric layer, the fabric layer for coupling to the flexible bag wherein the fabric layer is an intermediate layer between the lift member and the flexible bag.

In various embodiments, the lift member is coupled to the fabric layer by sewing.

In various embodiments, the fabric layer is configured to be attached to the flexible bag without sewing.

In various embodiments, the fabric layer includes a heat fusion coating for forming a heat seal with the flexible bag, and wherein the fabric layer is coupled to the flexible bag by positioning the fabric layer on the flexible bag and applying heat and pressure.

In various embodiments, the assembly is configured to attach to the flexible bag without puncturing or creating holes in the flexible bag.

In various embodiments, the assembly comprises a second lift member coupled to a second fabric layer, and wherein when the second fabric layer is coupled to the flexible bag, the second fabric layer is an intermediate layer between the second lift member and the flexible bag.

In various embodiments, the assembly comprises a third lift member coupled to a third fabric layer, and wherein when the third fabric layer is coupled to the flexible bag, the third fabric layer is an intermediate layer between the third lift member and the flexible bag.

In various embodiments, the assembly comprises a fourth lift member coupled to a fourth fabric layer, and wherein when the fourth fabric layer is coupled to the flexible bag, the fourth fabric layer is an intermediate layer between the fourth lift member and the flexible bag.

In various embodiments, the lift member is a first lift member and the fabric layer is a first fabric layer, and wherein the first, second, third and fourth fabric layers each include a heat fusion coating.

In various embodiments, the first lift member is sewn to the first fabric layer, the second lift member is sewn to the second fabric layer, the third lift member is sewn to the third fabric layer, and the fourth lift member is sewn to the fourth fabric layer, and wherein the first, second, third and fourth fabric layers are each coupled to the flexible bag by positioning each of the first, second, third and fourth fabric layers on the flexible bag at desired locations on a sidewall of the bag, and applying heat and pressure to the first, second, third, and fourth fabric layers.

In various embodiments, the first, second, third and fourth fabric layers are coupled to the flexible bag simultaneously.

In various embodiments, the first, second, third and fourth fabric layers are not coupled to the flexible bag simultaneously.

In various embodiments, a first heat fused seal is formed between the first fabric layer and the body, a second heat fused seal is formed between the second fabric layer and the body, a third heat fused seal is formed between the third fabric layer and the body, and a fourth heat fused seal is formed between the fourth fabric layer and the body.

In various embodiments, each of the first, second, third and fourth heat fused seals has a seal strength of 100 psi.

In various embodiments, the lift assembly can hold the weight of the contents of the bag when the bag is lifted by the lift members.

In various embodiments, the lift assembly can hold at least two times the weight of the contents of that the bag is designed to hold.

In various embodiments, the lift assembly can hold at least three times the weight of the contents that the bag is designed to hold.

In various embodiments, the lift assembly can hold at least four times the weight of the contents that the bag is designed to hold.

In various embodiments, the lift assembly can hold at least five times the weight of the contents that the bag is designed to hold.

In various embodiments, a flexible bag has a wall and comprises a lift assembly, the lift assembly including a lift member coupled to an intermediate layer, and wherein the intermediate layer is coupled to the bag wall.

In various embodiments, the lift member is sewn to the intermediate layer and wherein the intermediate layer is not sewn to the bag wall.

In various embodiments, the bag has at least a nearly air tight containment area and wherein the lift assembly is coupled to the bag wall so that the bag maintains the at least nearly air tight containment area without creating stitch holes or otherwise puncturing the bag wall.

In various embodiments, the layer of fabric includes a heat fusion coating and wherein the layer of fabric is coupled to the bag wall by positioning the layer of fabric on the bag wall at a desired location and applying heat to the layer of fabric.

In various embodiments, the lift member is a first lift member and the intermediate layer is a first intermediate layer and further comprising a second lift member and a second intermediate layer, a third lift member and a third intermediate layer, and a fourth lift member and a fourth intermediate layer.

In various embodiments, the first lift member is sewn to the first intermediate layer, the second lift member is sewn to the second intermediate layer, the third lift member is sewn to the third intermediate layer, and the fourth lift member is sewn to the fourth intermediate layer, and wherein the first, second, third and fourth intermediate layers are not sewn to the bag wall.

In various embodiments, the bag has an at least nearly air tight containment area and wherein the lift assembly is coupled to the bag wall so that the bag maintains the at least nearly air tight containment area.

In various embodiments, a first heat fused joint couples the first intermediate layer to the bag wall, a second heat fused joint couples the second intermediate layer to the bag wall, a third heat fused joint couples the third intermediate layer to the bag wall, and a fourth heat fused joint couples the fourth intermediate layer to the bag wall.

In various embodiments, the first, second, third and fourth heat fused joints each have a tensile strength of 100 psi.

In various embodiments, the lift assembly can hold at least the weight of the contents of the bag when the bag is lifted by the lift members.

In various embodiments, the lift assembly can hold at least two times the weight of the contents of the bag that the bag is designed to hold.

In various embodiments, the lift assembly can hold at least three times the weight of the contents of the bag that the bag is designed to hold.

In various embodiments, the lift assembly can hold at least four times the weight of the contents of the bag that the bag is designed to hold.

In various embodiments, the lift assembly can hold at least five times the weight of the contents of the bag that the bag is designed to hold.

In various embodiments, the bag is designed to contain 1,000 pounds of bulk material.

In various embodiments, the bag is designed to contain 2,000 pounds of bulk material.

In various embodiments, the bag is designed to contain 3,000 pounds of bulk material.

In various embodiments, the bag is designed to contain 4,000 pounds of bulk material.

In various embodiments, the bag is designed to contain 5,000 pounds of bulk material.

In various embodiments, the bag is designed to contain up to 500 pounds of bulk material.

In various embodiments, the bag is designed to contain 500 to 1,000 pounds of bulk material.

In various embodiments, the bag is designed to contain 1,000 to 2,000 pounds of bulk material.

In various embodiments, the bag is designed to contain 2,000 to 3,000 pounds of bulk material.

In various embodiments, the bag is designed to contain 3,000 to 4,000 pounds of bulk material.

In various embodiments, the bag is designed to contain 4,000 to 5,000 pounds of bulk material.

In various embodiments, the lift member is sewn a distance away from an edge of the intermediate layer.

In various embodiments, each of the first, second, third and fourth lift members are sewn to the respective first, second, third and fourth intermediate layers and are sewn a distance away from an edge of the respective first, second, third and fourth intermediate layers.

In various embodiments, the lift member is sewn at least an inch away from an edge of the intermediate layer.

In various embodiments, each of the first, second, third and fourth lift members are sewn to the respective first, second, third and fourth intermediate layers at least an inch from an edge of the respective first, second, third and fourth intermediate layers.

In various embodiments, the dimensions of the intermediate layer that is coupled to the bag wall determines the amount of weight that the lift assembly can hold.

In various embodiments, increasing the size of the intermediate layer increases the amount of weight that the lift assembly can hold.

In various embodiments, the lift member is a lift loop having a first end and second end, the first and second ends coupled to the intermediate layer a distance away from each other.

In various embodiments, the lift member is a lift loop having a first end and second end, the first and second ends coupled to the intermediate layer a distance away from each other.

In various embodiments, the lift member is coupled to the intermediate layer at least 1 inch below an edge of the intermediate layer.

In various embodiments, the lift member is coupled to the intermediate layer at least 1 inch below an edge of the intermediate layer.

In various embodiments, the lift member is coupled to the intermediate layer at least 2 inches below an edge of the intermediate layer.

In various embodiments, the lift member is coupled to the intermediate layer at least 2 inches below an edge of the intermediate layer.

In various embodiments, the lift member is coupled to the intermediate layer in an arch configuration.

In various embodiments, the lift member is coupled to the intermediate layer in an arch configuration.

In various embodiments, the fabric layer with the lift member coupled thereto is configured to be coupled to the bag via a coupler and wherein if the coupler fails or releases from the bag a containment area of the bag will not be torn or punctured or otherwise exposed.

In various embodiments, the intermediate layer is configured to be coupled to the bag via a coupler, wherein if the coupler fails or releases from the bag, a containment area of the bag will not be torn or punctured or otherwise exposed.

In various embodiments, further comprising more than one lift member and more than one intermediate layer, wherein a said lift member is coupled to a said intermediate layer.

In various embodiments, the said more than one intermediate layers are attached to the bag wall so that if the bag is picked up by less than all of the more than one lift members the intermediate layer is not put into a peel position.

In various embodiments, a method of producing a flexible bag with a lift assembly comprises:

providing a bag having a wall;

forming a lift assembly having a lift member coupled to an intermediate layer; and coupling the intermediate layer to the bag wall.

In various embodiments of the method, the lift member is not directly coupled to the bag wall.

In various embodiments of the method, the bag provided has a nearly airtight containment area.

In various embodiments of the method, the intermediate layer is coupled to the bag wall so that the bag maintains the nearly airtight containment area.

In various embodiments of the method, the intermediate layer is coupled to the bag wall via a coupler, the coupler configured to release from the bag wall if the coupler fails without ripping, tearing, breaching or otherwise damaging the bag wall and without exposing material contents of the bag.

In various embodiments of the method, more than one lift assembly is formed.

In various embodiments of the method, the lift member of each of the more than one lift assemblies is not directly coupled to the bag wall.

In various embodiments of the method, the bag provided has a nearly airtight containment area.

In various embodiments of the method, the intermediate layer of each of the more than one lift assemblies is coupled to the bag wall so that the bag maintains the nearly airtight containment area.

In various embodiments of the method, the intermediate layer is coupled to the bag wall via a coupler, the coupler configured to release from the bag wall if the coupler fails without ripping, tearing, breaching or otherwise damaging the bag wall and without exposing material contents of the bag.

In various embodiments of the method, the lift member has first and second ends and a top and bottom surface, and wherein prior to coupling the lift member to the fabric layer, the lift member is folded over or twisted at a location between the first and second ends and wherein the first and second lift member ends are coupled to the fabric layer after folding or twisting the intermediate layer so that a bottom surface of the first end is in contact with the fabric layer and a top surface of the second end is in contact with the fabric layer.

In various embodiments of the method and apparatus, the fabric layer includes a standard coating and the bag fabric includes a heat fusion coating, e.g., having propylene based plastomers and/or elastomers, for forming a heat seal with the flexible bag, and wherein the fabric layer is coupled to the flexible bag by positioning the fabric layer on the flexible bag and applying heat and pressure so that a bond is formed between the heat fusion coating and standard fabric coating.

In various embodiments of the method and apparatus, the fabric layer includes a heat fusion coating, e.g., having propylene based plastomers and/or elastomers, and the bag fabric includes a standard fabric coating, and wherein the fabric layer is coupled to the flexible bag by positioning the fabric layer on the flexible bag and applying heat and pressure so that a bond is formed between the heat fusion coating and standard fabric coating.

In various embodiments of the method and apparatus, the fabric layer includes a heat fusion coating, e.g., having propylene based plastomers and/or elastomers, and the bag fabric also includes a heat fusion coating, and wherein the fabric layer is coupled to the flexible bag by positioning the fabric layer on the flexible bag and applying heat and pressure so that a bond is formed between the heat fusion coating and standard fabric coating.

In various embodiments, the bond formed between a standard fabric coating on an intermediate layer of material and a heat fusion coating on bag fabric is the coupler between an intermediate layer and bag fabric.

In various embodiments, the bond formed between a standard fabric coating on bag fabric and a heat fusion coating on an intermediate layer of material is the coupler between an intermediate layer and bag fabric.

In various embodiments, the bond formed between a heat fusion coating and a heat fusion coating is the coupler between an intermediate layer and bag fabric.

In various embodiments, a fabric piece, e.g., a lift loop or intermediate layer, with a heat fusion coating thereon that faces bag fabric with a standard fabric coating, e.g., a standard polypropylene coating, can be coupled to the bag fabric by positioning the heat fusion coating of the lift loop or intermediate layer so that it faces the standard fabric coating of the bag and applying heat and pressure to form a bond or joint between the standard fabric coating and heat fusion coating.

In various embodiments, a fabric piece, e.g. a lift loop or intermediate layer, with a standard fabric coating, e.g., a standard polypropylene coating thereon, that faces bag fabric with a heat fusion coating, can be coupled to the bag fabric by positioning the standard fabric coating of the lift loop or intermediate layer so that it faces the heat fusion coating of the bag fabric and applying heat and pressure to form a bond or joint between the standard fabric coating and heat fusion coating.

In various embodiments, a fabric piece, e.g. a lift loop or intermediate layer, with a heat fusion coating, that faces bag fabric with a heat fusion coating, can be coupled to the bag fabric by positioning the heat fusion coating of the fabric piece so that it faces the heat fusion coating of the bag fabric and applying heat and pressure to form a bond or joint between the heat fusion coating of the fabric piece and the heat fusion coating of the bag fabric.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 5A-7A are schematic views of an assembly process for a lifting assembly in accordance with principles disclosed herein;

FIGS. 5B-7B are schematic views of an assembly process for a lift loop assembly in accordance with principles disclosed herein;

DETAILED DESCRIPTION OF THE INVENTION

Figure 1:
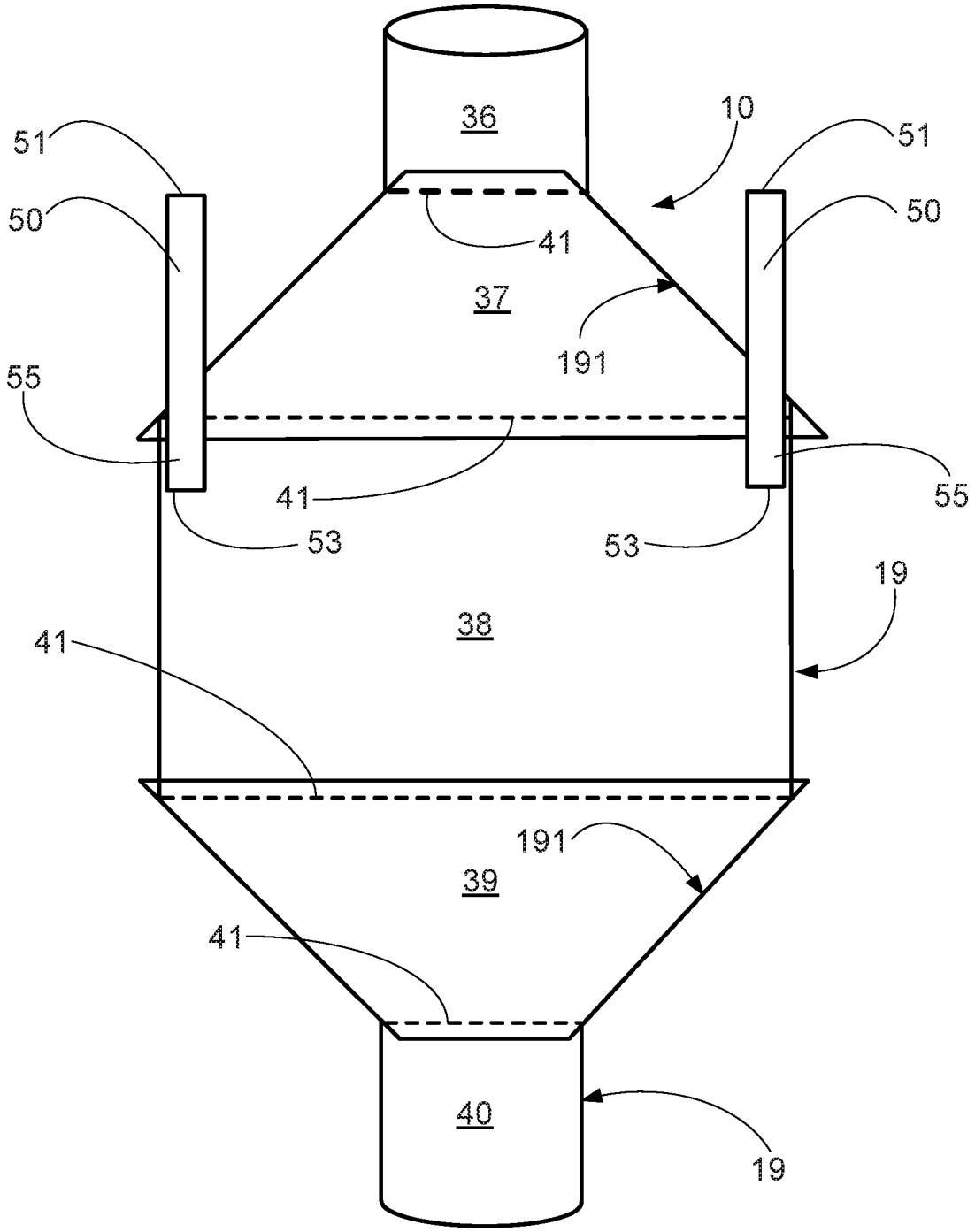
FIG. 1 is a schematic side view of an embodiment of a bulk bag including lift loops or straps directly coupled to the bag.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 is a schematic figure of a bulk bag 10. One or more embodiments of a lifting assembly 205 as described herein may be coupled to such a bulk bag 10. The bulk bag 10 as shown represents a large bag that can carry one to two tons of material, and in some cases more than two tons of material (e.g., 4,000 to 5,000 pounds of material), from one location to another. The lifting assemblies and method as described and shown herein can be used with such bulk bags, or can also be used with smaller bags, e.g., bags that are designed to carry 1 to 100 pounds of bulk material, or 100 to 500 pounds of bulk material. One or more embodiments of the lifting assemblies as described herein can be used with bags designed to carry 500 to 1000 pounds of bulk material, or 1000 to 2000 pounds of bulk material, or 2000 to 3000 pounds of bulk material, or 3000 to 4000 pounds of material, or 4000 to 5000 pounds of bulk material, or weights anywhere therebetween. One or more embodiments of the lifting assemblies as described herein can be used with bags designed to carry 5000 pounds or greater of bulk material.

A lifting assembly 205 can also be used with other types or designs of bulk bags not shown herein, e.g., bulk bags that have four pieces of fabric stitched together to form a continuous sidewall, for example, or baffled 4 loop bulk bags, or one and two lift loop design bulk bags.

A bag 10 can be filled with materials by gravity, for example, fed through a top spout 36. The top spout 36 can be coupled to an upper portion 37 at a seam or joint 41, which may be sewn, heat fused or heat sealed, or connected by other means. The upper portion 37 can be coupled to an intermediate portion 38 at another joint or seam 41. Intermediate portion 38 may also be referred to as a sidewall or body portion. (Unless otherwise noted, all joints or seams 41 can be sewn, heat fused, or connected by other means as discussed above). At a lower end of the intermediate portion 38, a lower portion 39 can be coupled at another joint or seam 41. Finally, at a lower end of the lower portion 39, a bottom or discharge spout 40 can be coupled at another joint or seam 41. Various inner 43 and outer 44 surfaces of the bulk bag 10 and its components as described above may include a coating or lamination 19 (see FIGS. 1, 9A-10, 15). The coating or lamination 19 can be a standard polypropylene fabric coating (e.g., a coating comprising a majority percentage of polypropylene and a small percentage of polyethylene) or a standard polyethylene fabric coating (e.g., a coating comprising polyethylene, or a mixture of polyethylene and other additives). Generally for polypropylene fabric bags, a standard polypropylene fabric coating or lamination is applied to one more surfaces of the polypropylene fabric. Generally for polyethylene fabric bags, a standard polyethylene fabric coating or lamination is applied to one more surfaces of the polyethylene fabric.

In bags including heat fused joints or seams, some surfaces of a bulk bag 10 as described herein and its components preferably include a fusion or heat sealing coating 191 which may be used in bonding, while other surfaces include a standard polypropylene fabric coating or standard polyethylene fabric coating (depending on whether the bag fabric is polyethylene or polypropylene). A fabric piece with a heat fusion coating facing another fabric piece with a heat fusion coating can be joined to form a joint 41 by adding heat and pressure. A fabric piece with a heat fusion coating facing a fabric piece with a standard polypropylene fabric coating for example, can also be joined to form a joint 41 by applying heat and pressure. A fabric piece with a heat fusion coating facing a fabric piece with a standard polyethylene fabric coating, for example, can also be joined to form a joint 41 by applying heat and pressure. Reference is made to patent publication numbers WO2014/197728, US2014/0363106, WO2014/197727, and US2014/0360669, incorporated herein by reference for additional information on forming heat fused joints in a bulk bag.

A fusion or heat sealing coating 191 preferably comprises propylene based plastomers and elastomers. Various embodiments of a heat sealing coating can comprise propylene based elastomers, propylene based plastomers or a combination thereof. More preferably, the coating comprises about 50% to 90% of propylene-based plastomers, propylene-based elastomers, or mixtures thereof and about 10% to 50% polyethylene resins and additives, having a melting point that is preferably at least about 5 degrees lower than the melting point of the fabrics to be joined together.

Portions 37, 38, and 39 may sometimes together be referred to herein as a containment area or body of the bag 10. Intermediate portion 38 may also be referred to as a body panel or body portion or side wall of a bag 10.

In the bag 10 as shown in FIG. 1, lift members or lift loops 50 are directly coupled to the bag fabric, such as at the body portions 38, and possibly at upper portion 37 at a connection point 55. Connection points 55 typically are in a containment area of the bag. Lift members 50 can be loops or straps. Lift members 50 in prior art bulk bags are generally sewn or stitched directly to bag fabric. Sometimes, lift members 50 may be coupled to a bag 10 via heat fusion, per methods as described in WO2014/197728, US 2014/0363106, WO2014/197727, and US2014/0360669, for example, or via an adhesive. The lift loops 50 as shown include an upper or lift end 51 and a lower or connection end 53 coupled at the connection point 55. When the bulk bag 10 must be transported, the lift loops 50 can be used to lift the bulk bag 10. As discussed above, when lift loops 50 are stitched or sewn directly to bag fabric, e.g., in a containment area of a bag, problems including weakened fabric at stitch areas, and safety issues if a lift loop fails and tears away from the bulk bag fabric arise.

A bulk bag 10 can be emptied by gravity, or via other suitable discharge means, through a discharge spout 40. Before discharge, a discharge spout 40 is preferably closed in such a manner that the contained materials are prevented from discharging until the bag 10 is properly positioned over a receiving hopper or other desired receptacle and ready for discharge, e.g., suspended by lift loops over a receiving hopper or other receptacle. FIGS. 2-2A and FIGS. 3-3A illustrate examples of bulk bags that a lifting assembly 205 can be used with, the bulk bags shown including different discharge assemblies as described further below.

FIGS. 2 through 14D illustrate features of a lifting assembly 205 in one or more embodiments of the apparatus and method of the present invention. A lifting assembly 205 can be utilized with various types and designs of bulk bags, including with bulk bags that have one or more stitched seams or joints, and with bulk bags that do not include stitched seams or joints, e.g., bags that include all heat fused joints. A lifting assembly 205 preferably includes a lift loop or lift member assembly 210 and a bag connection assembly 220, which are illustrated in the figures in accordance with principles disclosed herein. Lift loop assembly 210 preferably includes a lift loop or strap 212 with an upper or lift end 214 and with lower or connection ends 216. At times herein an end 216 is also referred to as a lift loop leg 216. A lift loop 212 has a bottom surface 225 and a top surface 226 (see FIGS. 9A-10 and 14A-B). A lift loop 212 can be formed from an ounce polypropylene fabric or from the same fabric used to form bag 10.

A bag connection assembly 220 preferably includes a patch or intermediate member 222 and a connection 224. Preferably patch or intermediate member 222 is configured to be directly coupled to the fabric of bag 10, e.g., on an intermediate panel or side wall 38, and/or at one or more other walls of a bag 10. An intermediate member 222 can be coupled to a bulk bag 10, for example, wherein it extends from one side wall (e.g., at side walls 251, 252, 253, 254 of intermediate panel 38) across a corner, e.g., corner location 261, 262, 263, 264, respectively, to an adjacent sidewall (see FIGS. 8-10). Patch or intermediate member 222 has a bottom surface 240 and a top surface 241 (see FIGS. 14C-D).

Preferably a lift assembly 210, is directly coupled to top surface 241 of an intermediate member 222 and is not directly coupled to the bag 10 fabric, e.g., to a bag wall or otherwise to an outer surface 44 of a bag 10. Preferably a bottom surface 240 of patch or intermediate member 222 is directly coupled to a bag 10, with a joint or coupling formed between a coating on the bottom surface 240 of patch 222 and a coating on an exterior surface 44 of the bag fabric, as will be described further below. Patch 222 can be single layer ounce polypropylene fabric. Patch 222 can be the same or similar to the polypropylene fabric used to form a bag 10.

A lift assembly 205 is an improvement over prior art lift loops that are directly coupled to the bag fabric, e.g., via stitching or sewing. As discussed above, if directly stitched or sewn to bag fabric, e.g., at a side wall or intermediate wall 38, if the lift loop of lift assembly 210 fails, e.g., tears away from a patch 222, or otherwise becomes uncoupled from patch 222, the bag fabric itself will be undamaged since the lift loop or member 212 is not directly coupled to the bag fabric. Additionally, preferably patch or intermediate member 220 is not stitched to a bag 10 but coupled to a bag 10 via heat fusion or with suitable adhesives. Thus, if a patch 222 tears away from a bag 10, or otherwise becomes uncoupled from a bag 10, then the bag fabric will not be torn or ripped. A containment area of a bag 10, therefore, is left unaffected and/or undamaged if a lift assembly 205 with a stitched lift loop assembly 222 and heat fused bag connection assembly 220 fails, without material contents of the bag being exposed to air or moisture or otherwise contaminated, and without leaking from a bag 10.

In a lift assembly 205, although lift loops 212 of lift loop assembly 210 can be heat fused to a patch 222, or coupled to patch 222 with an adhesive, preferably loops 212 are sewn or stitched to patch 222, with patch 222 then not being sewn or stitched directly to the bag fabric. When lift loops or members 212 are attached directly to bag fabric, or to a patch or intermediate member 222 via heat fusion or an adhesive, if pulled or lifted in a sheer position, the lift loops or members can hold enormous weights, but if pulled in a peel position (e.g., if one attempts to the move the bag by only one lift loop, or less than all of the lift loops on a bag, or with attempts to lift the bag via the lift loops in a direction otherwise than upwards), such loops have weak peel strength and can easily detach from a bulk bag or intermediate member or patch 222. Lift loops 212 attached via heat seal can have weak resistance to peeling forces, for example, if a lift loop is pulled in a 90 degree angle away from the bag, it is put into a peel position and is likely to fail. By stitching a lift loop 212 to a patch 222 that is heat fused to a bag 10, in this manner, for a bag 10 with a lifting assembly 205 and all heat fused seams or joints, a containment area of the bag 10 remains nearly air tight even if the lifting assembly fails, and if lift loops 212 are sewn to a patch 222 problems associated with weak peel strength of heat fused loops 212 can be lessened or eliminated.

Although a patch 222 can be sewn or stitched to a bulk bag 10, preferably it is heat fused, or coupled to a bag 10 with an adhesive, to prevent creation of stitch holes in bag 10 fabric or weakening of the bag 10 fabric at the stitch location.

Figure 4:
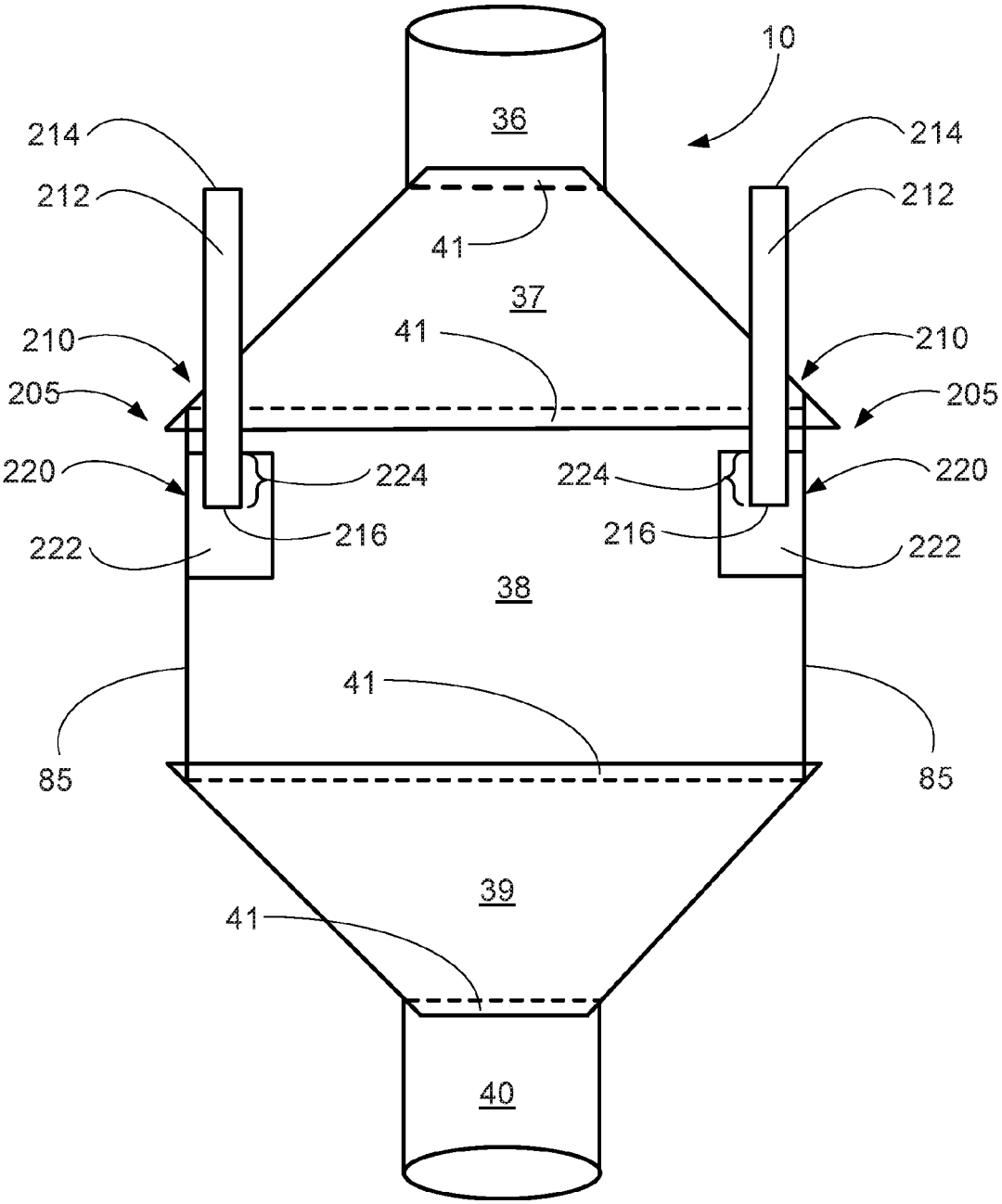
FIG. 4 is a schematic side view of an embodiment of a bulk bag, in folded configuration, including a lifting assembly with lift loops or straps in accordance with principles disclosed herein.

Referring now to FIG. 4, an embodiment of a bulk bag 10 is shown in schematic view, including lifting assemblies 205, with lift loop assemblies 210 and bag connection assemblies 220, in accordance with principles disclosed herein. A portion of two lifting assemblies 205, each including a patch or intermediate member 222 and a lower end 216 of lift loop 222 at connection 224.

Referring now to FIGS. 5A-7A and 5B-7B, two different embodiments of the process of forming a lifting assembly 205 are depicted. In both embodiments shown, the process of forming a lifting assembly 205 with a lift loop assembly 210 and connection assembly 220 preferably begins with providing a patch or intermediate member 222, which may be a patch of fabric made from the same material as an intermediate or side wall portion 38 of the bulk bag 10 (e.g., polypropylene or polyethylene fabric). A patch 222 preferably can be made from polypropylene fabric when being used with a polypropylene fabric bag. Alternatively, a patch 222 can be made from polyethylene fabric when used with a polypropylene or polyethylene bulk bag for example. A lift loop or member 212 is also provided, which preferably can be made from polypropylene fabric when being used with a polypropylene fabric bag. Alternatively, a lift loop or member 212 can be made from polyethylene fabric when used with a polypropylene or polyethylene bulk bag for example.

Figure 7A:
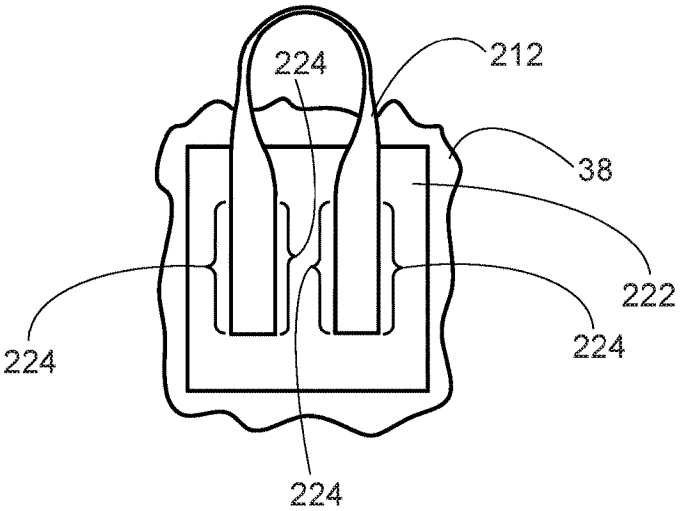
Figure 5A:
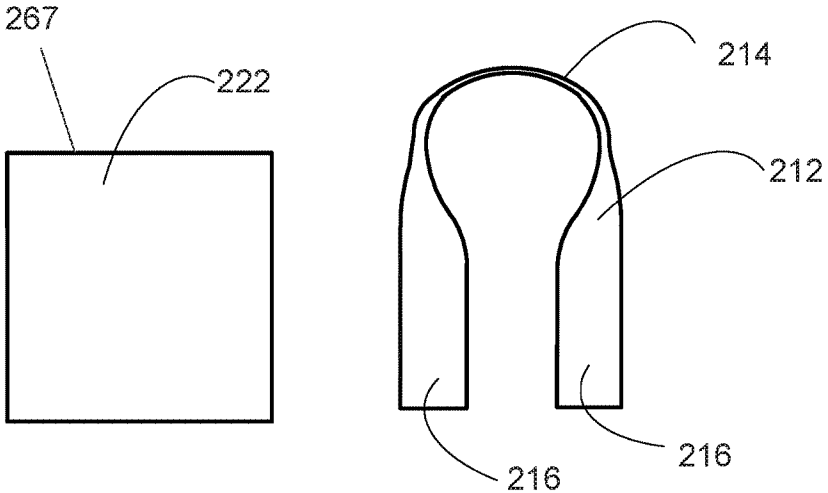
Figure 6A:
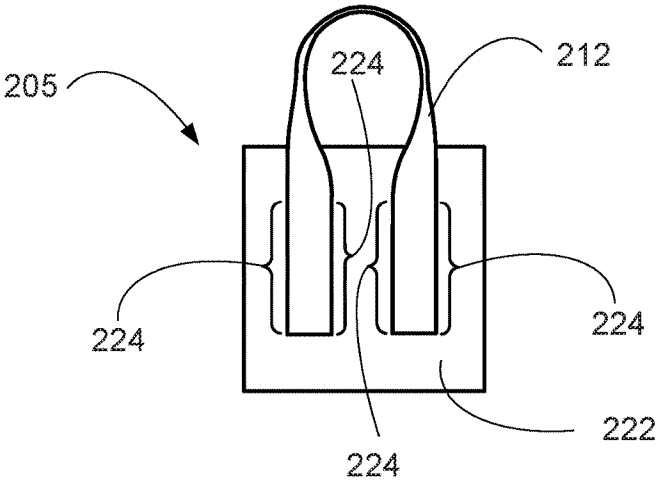

In FIGS. 6A-7A and 6B-7B a lift loop 212 is positioned on patch 222 in a desired location and then ends or legs 216 are connected or attached to a patch 222 at connection area 224. Ends or legs 216 of a lift loop can be attached to patch 222 via heat fusion or adhesive (see FIGS. 6A-7A), or in the most preferred embodiments, ends or legs 216 of a lift loop 212 are sewn or stitched to a patch 222 at connection area 224 (see FIGS. 6B-7B). As shown in FIGS. 7A, B, patch 222 can then be separately connected, attached or coupled to the bag, e.g., at intermediate portion 38.

Figure 7B:
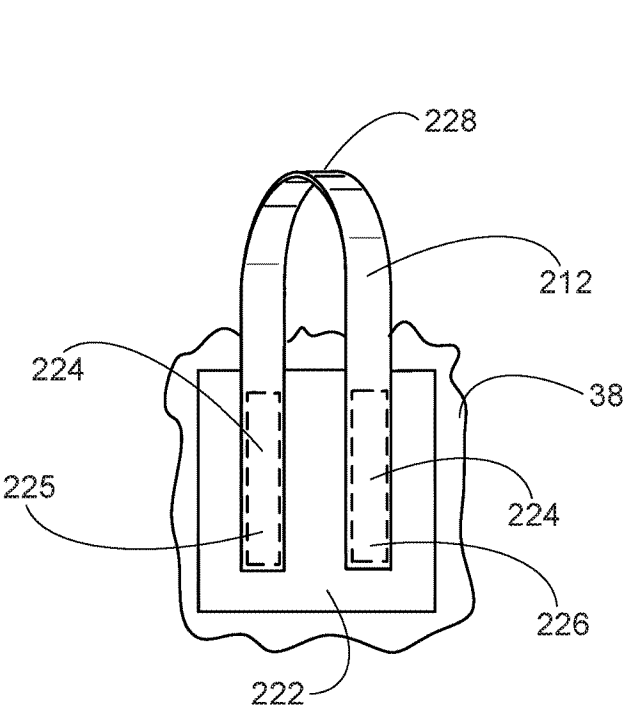
Figure 5B:
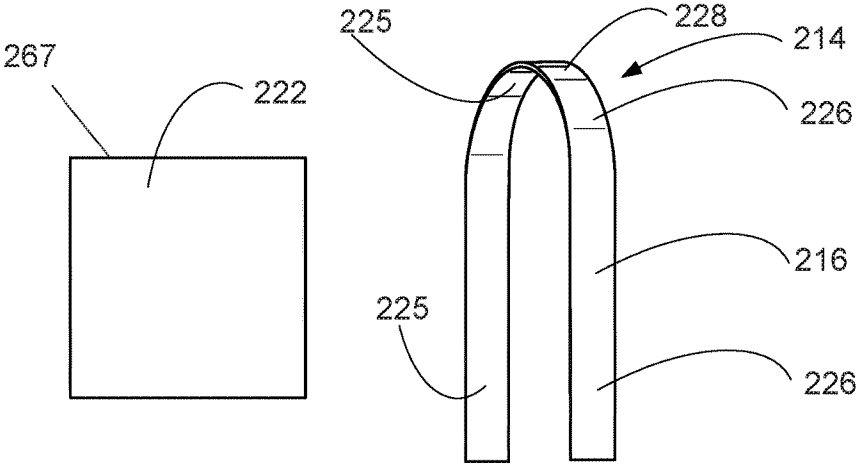
Figure 6B:
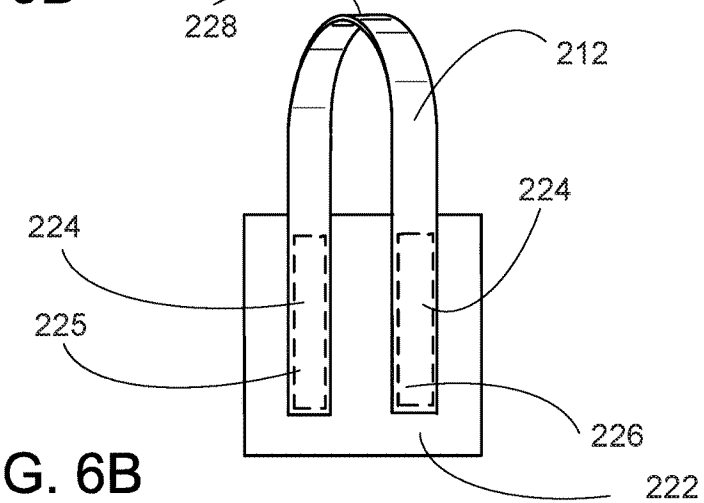
Figure 8:
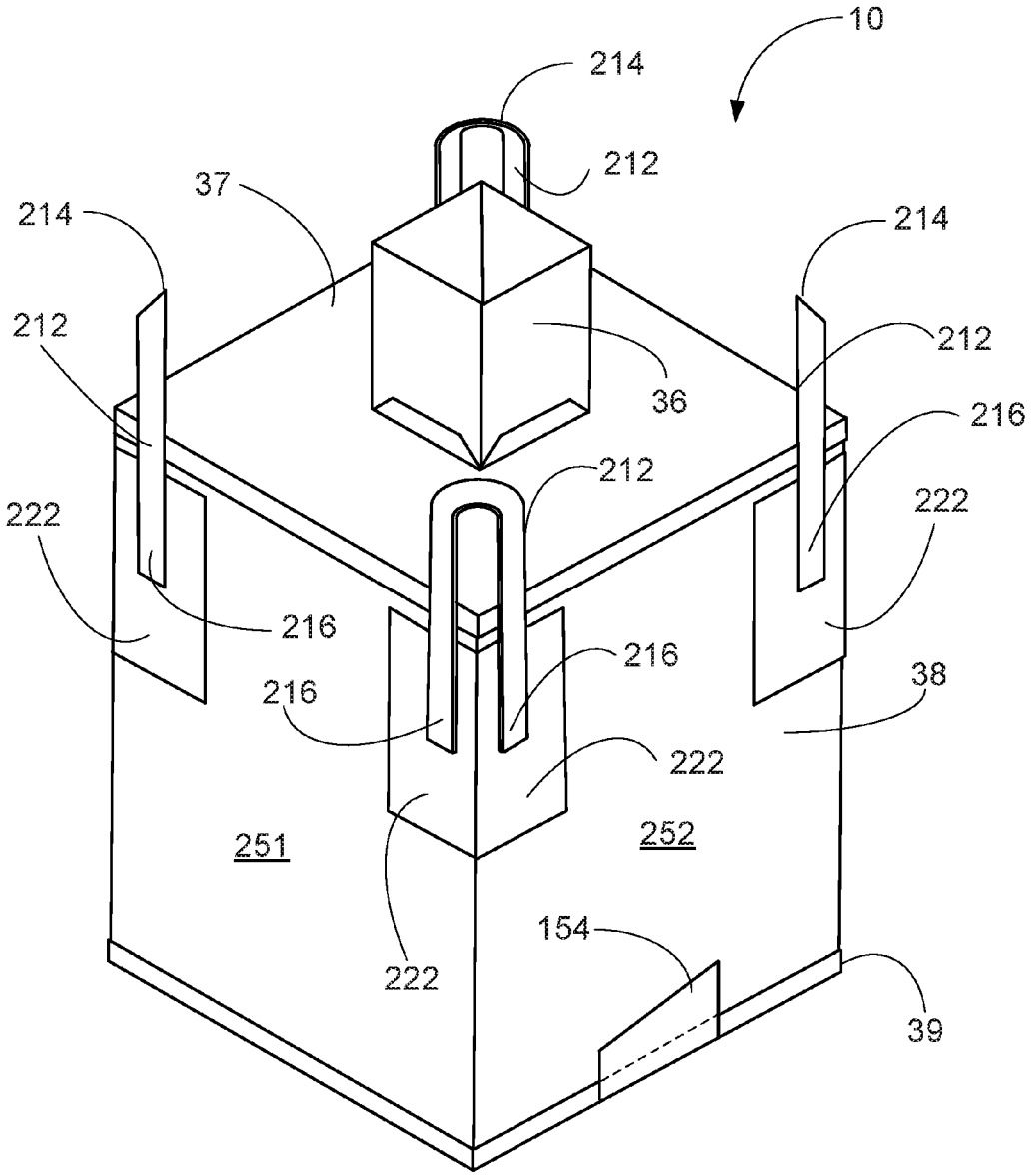
FIG. 8 is a perspective view showing a bulk bag with a plurality of lifting assemblies in accordance with principles disclosed herein.

FIG. 7B depicts stitching along a perimeter of legs or ends 216 at connection area 224. A heat fused connection or adhesive if used as per FIGS. 6A-7A preferably extends across the width and length of loop legs or ends 216 in the connection area 224, wherein the loop is coupled to patch 222 so that there are no graspable edges along sides and the bottom of the lift loop end 216 in the connection area 224.

To later release a lift loop with a heat fused connection or adhesive at a desired time, it could be pulled away from the patch in a peel position.

As discussed, in the most preferred embodiments, a patch 222 is heat sealed or heat fused, or otherwise adhered to a bag 10 without sewing or stitching. Preferably a patch 222 includes a heat fusion coating 191 or standard laminate coating 19 on bottom surface 240 of patch 222 (see FIGS. 9A, 15C). Preferably, ends or legs 216 of lift members 212 are positioned in a desired location on top surface 241 of patch 222 and then sewn or stitched thereto in connection area 224 (see FIGS. 6B-7B).

If a patch 222 will be coupled to a body portion 38 that includes a standard polypropylene or standard polyethylene fabric coating on an exterior surface 44 of body portion 38, then preferably patch 222 has a heat fusion coating 191 on bottom surface 240 of patch 222. Patch 222 could also have either a heat fusion coating 191 or a standard polypropylene coating 19 on a bottom surface 240 of the patch 222 if a bag intermediate portion 38, or other portion of a bag 10 to which the patch will be coupled, has a heat fusion coating 191 on an exterior surface 44.

Preferably a bag body or intermediate portion 38 will include a standard coating 19, and patch 222 will include a heat fusion coating 191. In this manner, less heat fusion coating 191, which is more expensive than standard coatings 19, is utilized during the overall process of a making a bag with a lift assembly 205, resulting in lower cost.

To attach a patch 222 to a body or intermediate portion 38 or other bag wall, a bottom surface of patch 222 having a standard 19 or fusion 191 coating is preferably positioned over an exterior surface of bag body portion 38 having either a standard 19 or heat fusion coating 191, respectively, in a desired position and heat and pressure is applied. For more information on heating sealing or fusing, or adhering polypropylene or polyethylene fabric pieces, reference is made to patent applications WO 2014/197728, US 2014/0363106, WO 2014/197727, and US 2014/0360669, incorporated herein by reference, for further detail.

In some embodiments, by sewing the lift loop 212 to the patch 222 of fabric not initially associated with product containment area fabric, e.g. at intermediate portion 38, sewing is not applied to the product containment area fabric, e.g., at intermediate portion 38. Instead, the patch 222 is an intermediate layer of fabric that is attached to the product containment fabric using either a heat fusion or seal method, or by using an adhesive. In other words, sewing or stitch holes from attaching lift loops in a product containment area can be eliminated.

When a patch 222 is coupled to bag 10 fabric via heat fusion, a joint is formed between the standard fabric 19 and fusion coating 191 of the patch or bag fabric respectively, or between fusion coating 191 and fusion coating 191 of the patch or bag fabric respectively. If a heat fused joint fails, or if an adhesive bond fails (e.g., breaks away or otherwise becomes uncoupled from the bag 10 fabric), the heat seal and adhesive do not cause the bag fabric (e.g., intermediate portion 38 of the bulk bag 10), to fail. If a heat fused joint or adhesive fails so that a heat fused joint degrades or breaks away, the intermediate layer or patch 222 is released from the bag body or fabric without damaging the bag fabric or a containment area of the bag. Should a sewn lift loop 212 connection at area 224 fail, the lift loop 212 that is sewn to a patch 222 may tear only the patch 222 and not the bag fabric, and the contained product remains secure in the bulk bag 10 without damage to the product or the environment. Likewise if a heat fused connection of lift loop 212 in area 224 of patch 222 should fail, the containment area of the bag and bag fabric is left unaffected.

In exemplary embodiments, the heat seal method described herein and in the noted patent applications incorporated herein by reference, produces a heat seal or fused joint tensile strength of about 100 psi. Since bulk bags are expected to provide a lifting safety ratio of 5 to 1, then, for example, a bulk bag carrying a 2,200 pound load would need to generate about 11,000 pounds of lift. Therefore, if used with a said bag, each lifting assembly 205 must have around 3,750 pounds of lift to meet this standard. Based on current test results, at 100 psi, a minimum of about 38 square inches of patch 222 material needs to be heat fused or adhered wherein the resulting heat fused joint is at full strength. A heat fused joint is considered herein to be at full strength if the joint retains at least about 90% of the fabric strength. A fabric patch can be coupled to a bag wherein a heat fused joint formed between bag fabric and patch 222 extends along an entire bottom surface 140 of patch 222, which can create a full strength joint or a joint that retains at least 90% of the fabric strength. Preferably a patch 222 is coupled to the bag 10 fabric so that there are no graspable edges of the patch 222, e.g., no edges that can be gripped or grasped, or unintentionally or accidentally pulled or snagged during handling of a bag 10.

Testing has shown that as such a bag is lifted with weights of about 2,200 lbs, forces against the lift loop attachment or joint are not always evenly applied, and the attachment seals or joints can be affected unevenly from edges of the seal or joint. Thus, in certain embodiments, a patch 222 that is about 18 inches wide by 18 inches long is preferably used. Such a patch size provides the full lifting safety needed to qualify a bulk bag 10 for 5 to 1 lifting safety requirements for 2,200 lbs. As illustrated in FIG. 13B, a patch 22 can also be about 18 by 18.5 inches.

In some embodiments, by changing the size of the patch 222, greater or lesser weights can be carried by the bulk bag 10. In various embodiments the size of the patch selected is selected based on the bag to which it will be coupled and the weight for which the bag is designed to carry.

While many different configurations are available to create a strong lift loop patch assembly, in certain embodiments a lift loop 212 is applied in an arch configuration. In some embodiments, the arch loop spreads the lift loop legs or ends 216 apart at the point of sewing or otherwise coupling the lift loop ends 216 to the patch 222 (as shown in FIGS. 6A, 7A and 6B, 7B, connection areas 224). Further, the legs or ends 216 are preferably separated far enough, e.g., at least about 4 inches apart, or about 4 to 8 inches apart, to provide a distance between the legs or ends 216 that includes an area of patch 222 that will be, or is, coupled to the bag, to decrease the number of stress points affecting the attachment points. In some embodiments, a patch 222 can have a total surface area of about 324 square inches. However, the connection area 224 involving the attachment of the lift loop 212 covers only about 240 square inches. As discussed above, a connection area 224 is preferably not heat sealed or otherwise coupled to the bag body portion 38, but is the area in which a lift loop end or leg is separately attached to a patch 222.

In some embodiments, a lift loop or member 212 is twisted or folded prior to sewing it to a patch 222, e.g., at twist or fold area 228 as shown in FIGS. 5B-7B. A lift loop 212 can have a top surface 226 and a bottom surface 225. After twisting a lift loop or member 212, the bottom surface 225 of a first leg or end 216 is coupled to a patch 222 at area 224, and a top surface 226 of second leg or end 216 is coupled to a patch 222 at connection area 224. This half twist makes the distance along the loop equal when the loop legs are about 90 degrees to each other. The twist can be advantageous because it makes the distance along a loop formed with lift member 212 equal when the loop legs or ends 216 are positioned about 90 degrees respective to each other. This embodiment can provide additional strength to a lift loop assembly 205.

As discussed above, when attaching a lift loop assembly 210 via heat sealing to a patch 222, this means the heat seals can have weak resistance to peeling forces. If the lift loop is pulled in about a 90 degree angle away from the bag, it is put into a peel position and is likely to fail, e.g., the bond joining the lift loop to the patch or bag will break or tear or peel away. To address this, in some embodiments, the sewing of the lift loop 212 ends 216 to the patch 222 includes beginning a top-down sewing process starting at about two inches below the top of a patch 222. In other words, the top of the connection area 224 begins at around two inches below the top of the patch 222. In some embodiments, such a sewing arrangement allows heat sealing and part of a heat fused joint between the patch 222 and bag fabric above the sewn attachment area 224. By heat sealing the patch 222 to the side wall or intermediate portion 38 of the bag 10, the joint of the lift loop is taken out of a peel position. By avoiding the peel position for the loop 212, improper handling conditions such as not maintaining the loops in a vertical position relative to the bag can be avoided.

In other embodiments a connection area 224 can start at or near a top edge 267 of patch 222, or at or about 1 inches downward from a top edge 267 of patch 222. In other embodiments a connection area 224 can start about 1 to 3 inches below or downward from a top edge 267.

Preferably ends 216 of lift loops or members 212 are spaced a distance away from side and bottom edges of a patch 222 as shown, for example, in FIGS. 6A-7B, e.g., spaced about 2 to 4 inches away from a side edge, and about 3 to 7 inches away from a bottom edge of intermediate patch 222.

As discussed, preferably a lift loop assembly 210 is attached to a patch 222 rather than being attached directly to the bag fabric, e.g. at an intermediate or body portion 38 or other wall of a bag. More preferably, a patch 222 with a lift loop 212 securely sewn to it is attached to the side walls or body portion 38 of a bag 10 via heat seal or adhesive. Most preferably, a patch 222 and lift loop 212 combination preferably includes a heat seal portion connecting the patch to the bag that is at least about 1 inch above the sewn portion to protect the patch seal or joint from being put into a peel position if the bag is picked up by less than 4 loops, for example.

In various embodiments a patch 222 can be attached at or near a top edge of a bag body portion 38 or sidewall of a bag 10. In various embodiments a patch 222 can be attached to bag body portion 38 or sidewall of a bag 10 a distance below, or down from, a top edge of a bag intermediate or body portion 30, or a sidewall of a bag 10.

Loop impulse heat sealer machinery can be used in various embodiments of the method of the present invention, e.g., when heat sealing patch 222 with loops 212 coupled thereto to a bag 10. As previously discussed lift loops 212 can be sewn to a piece of fabric or patch 222, wherein this is the only sewing on an entire bag 10, and no stitch holes penetrate a containment area of bag 10. Alternatively loops 212 could be fused to a piece of fabric or patch 222 or to a bag 10 itself. Patch 222 can be sealed or heat fused to the bag 10 with a heat sealing bar, applying heat and pressure to a patch 222 that is positioned in a desired location over a bag 10, e.g., at in a desired location over body portion 38. Preferably a heat sealing bar provides a rocking motion when carrying out the heat sealing process to promote and even seal of patch 222 to the bag 10 fabric.

In some embodiments loops or lift members 212 can be configured so as to not be perfectly parallel. For example, wherein one lift leg or end 216 is not perfectly parallel to another lift leg or end 216 of the lift loop 212 when coupled to a patch 222. Also one lifting assembly 205 can be not perfectly parallel to another lifting assembly 205 on a bag 10.

Figure 15A:
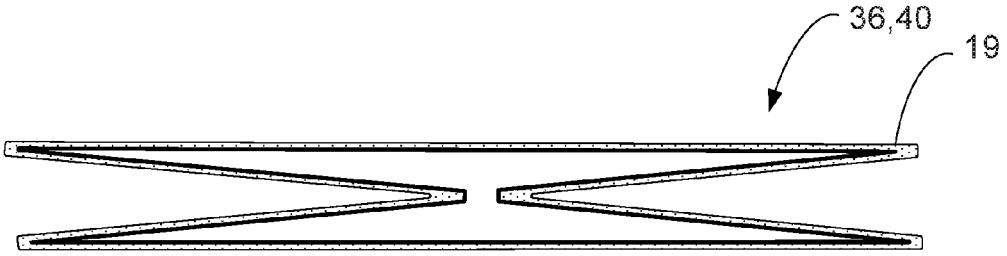
FIG. 15A illustrates an end view of an embodiment of a folded, gusseted fill or discharge spout, of a bag as shown in FIGS. 8-13 for example.
Figure 15B:
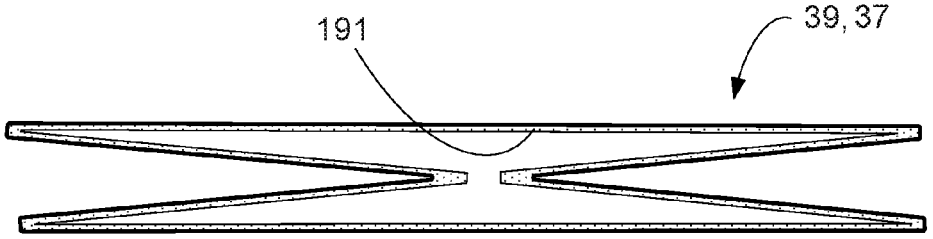
FIG. 15B illustrates an end view of an embodiment of a folded, gusseted top or bottom panel, of a bag as shown in FIGS. 8-13, for example.
Figure 15C:
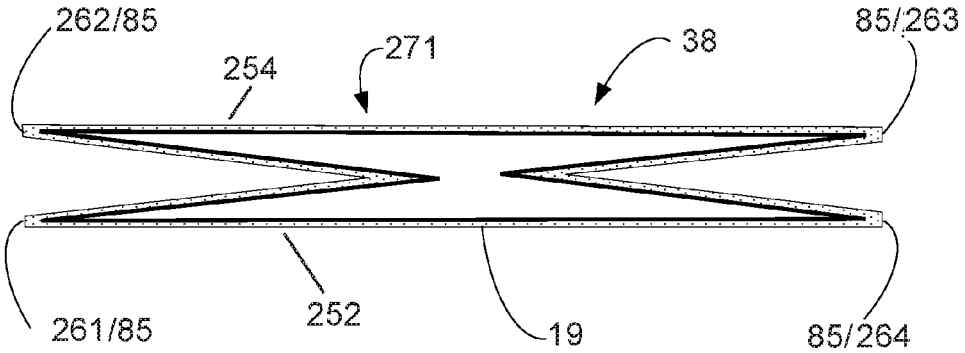
FIG. 15C illustrates an end view of an embodiment of a folded, gusseted bag body portion or intermediate portion of a bag as shown in FIGS. 8-13, for example.

Referring now to FIGS. 15A-15C. FIG. 15A illustrates an end view of an embodiment of a folded, gusseted fill or discharge spout 36, of a bag 10 as shown in FIGS. 9A-FIG. 11 for example. FIG. 15B illustrates an end view of an embodiment of a folded, gusseted top 37 or bottom panel 39, of a bag 10 as shown in FIGS. 9A-FIG. 11, for example. FIG. 15C illustrates an end view of an embodiment of a folded, gusseted bag body or intermediate portion 38 of a bag as shown in FIGS. 9A-FIG. 11 for example. To heat fuse the respective fabric pieces together and from heat seal seams or joints 41, a fill spout 36 can be positioned to overlap with top 37 while in folded gusseted form, e.g., wherein a standard coating on one surface of fill spout 36 is in contact with a fusion coating on top 37 in an overlapped area. Applying heat and pressure to the overlapped area can form a joint 41. A discharge spout 40 can be joined to a bottom 39 in a similar manner. Likewise a top 37 can be joined to intermediate portion 38 and a bottom 39 can be joined to intermediate portion 38 in similar manner.

Figures 9A, 9B:
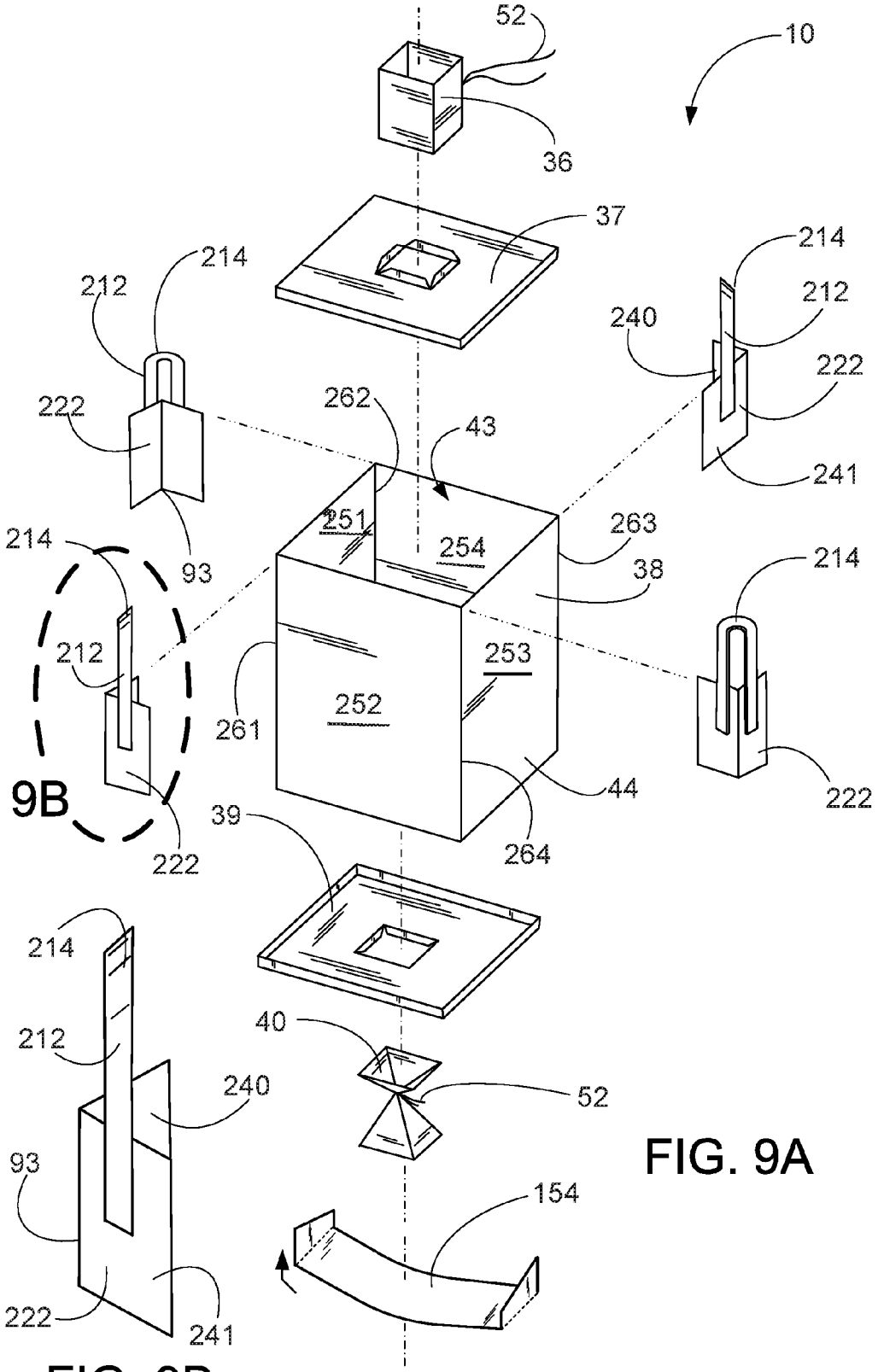
FIG. 9A is an exploded view of an embodiment of a bulk bag including a plurality of lifting assemblies in accordance with principles disclosed herein.
FIG. 9B is close up view of a lifting assembly as shown in FIG. 9A.
Figure 10:
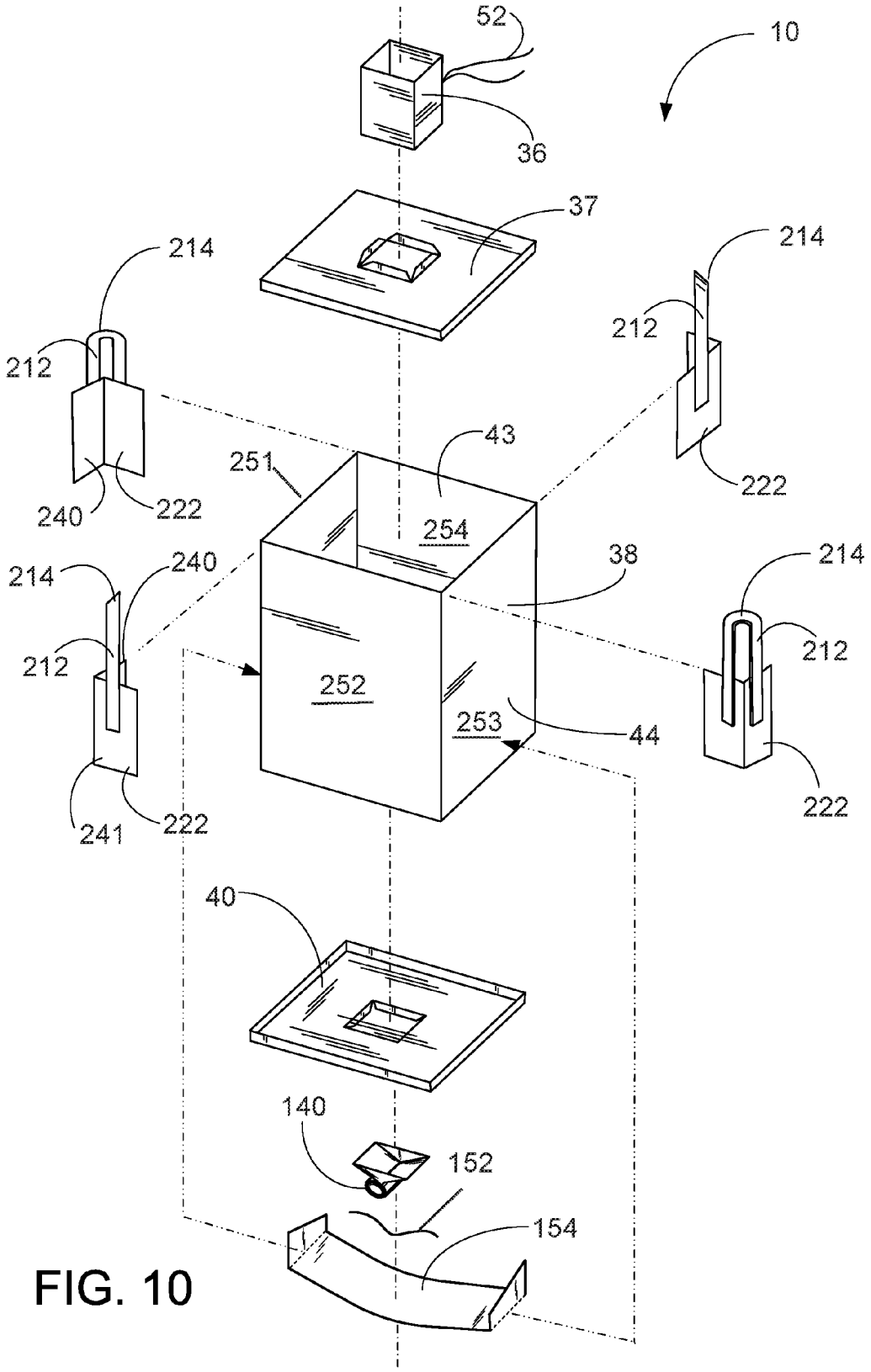
FIG. 10 is an exploded view of a bulk bag including a plurality of lifting assemblies in accordance with principles disclosed herein.
Figure 11:
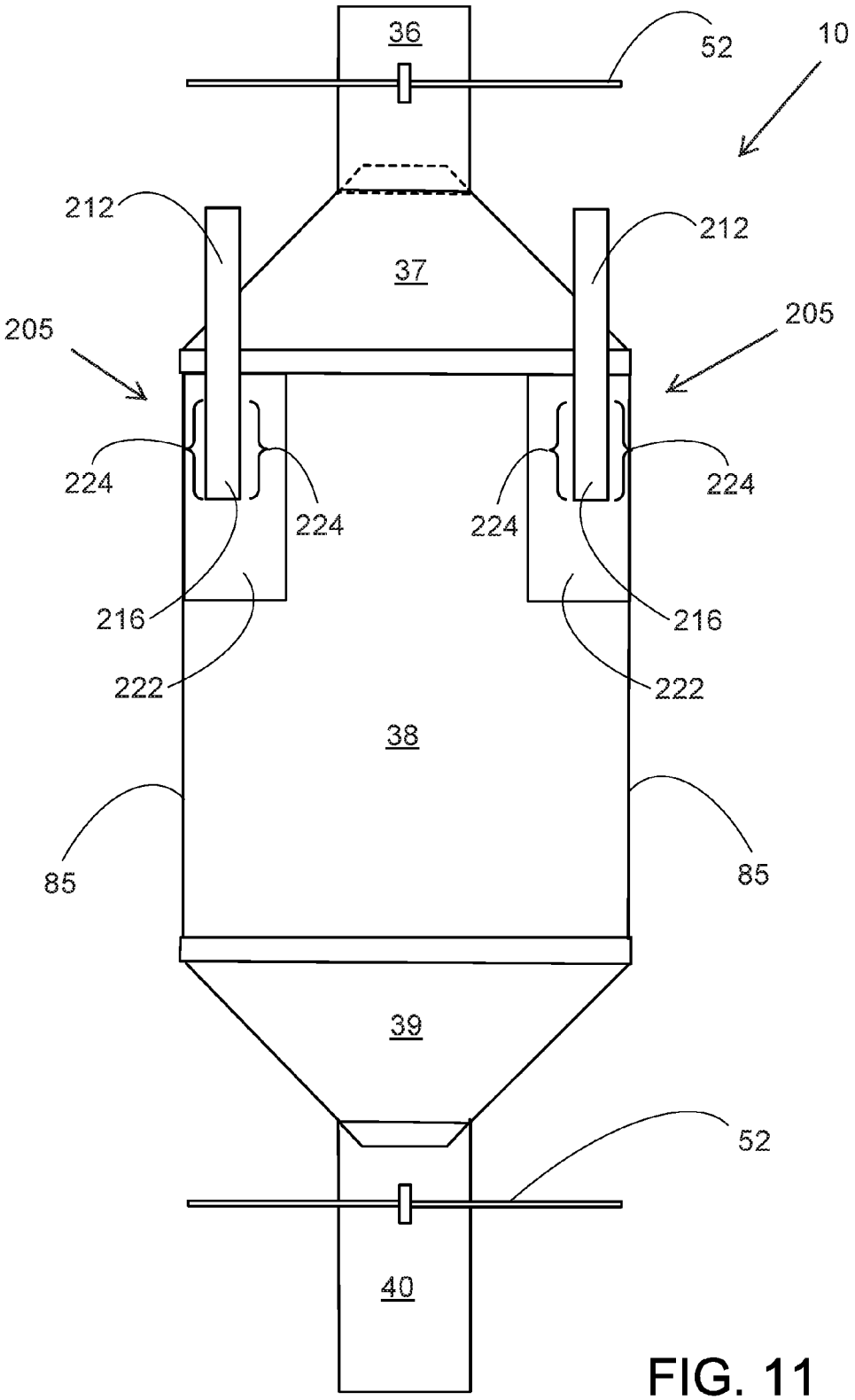
FIG. 11 is top view of bulk bag in a substantially flat, folded configuration, including lifting assemblies in accordance with principles disclosed herein.

Preferably when heat fusing a patch 222 to a bag 10, a patch 222 including a lift loop assembly 210 is folded at or near a center position 93 preferably at a location in between each end 216 of loop 212, and the center fold at 93 is preferably positioned on or near a corner area of bag 10 when bag 10 is in folded gusseted form, preferably like an envelope, at one or more folds 85 (see FIGS. 9A-9B and 15C). Respective folds 85 can become corner areas 261, 262, 263, 264 when a bag 10 is unfolded and filled with bulk material. In this configuration, about one half of a patch 222 with one end 216 of lift loop 212 is positioned under a fold 85 and about one half of patch 222 and the other end 216 of a lift loop 212 is positioned over a fold 85. Preferably a bottom surface 240 of patch 222 includes a fusion coating 191 and can be heat sealed to body fabric having a standard coating 19. Alternatively both bottom surface 240 of patch 222 and exterior surface 44 of intermediate portion 38 could have a fusion coating 191. A patch 222 could also have a standard coating 19 on bottom surface 240 when being heat fused to an intermediate portion 38 having a fusion coating 191 thereon.

Referring to FIG. 15C, heat and pressure preferably is applied from the direction of surface 271 downward, wherein heat travels to and through lift assemblies 205 in folded configuration on intermediate portion 38 downward, through each layer of fabric of the gusseted intermediate portion 38 with the lift assemblies 205 folded thereon. In this manner, four lift loop assemblies 205 can be attached to a bag 10 simultaneously. Alternatively two lift loop assemblies 205 could be attached to a bag 10 simultaneously, or each lift loop assembly could be attached to a bag 10 one at a time, in turn.

Depending on the type of bulk bag, in various embodiments less than 4 lift loop assemblies 205 can be attached to a bag 10. For example, some types of bulk bags are designed to have only 1 or 2 lift loops; thus, for those bags only 1 or 2 lift loop assemblies can be coupled to a bag as needed.

In embodiments wherein lift loops 212 are sewn to patches 222, with patches 222 heat fused to a polypropylene bag, the lifting assembly 205 is preferably in a shear position and can lift very heavy weights, e.g. about 500 to 5000 lbs of bulk material. In testing, the lift loops 212 secured in this manner to a bag 10 have been able to lift weights equivalent to that of an RV.

Figure 2A:
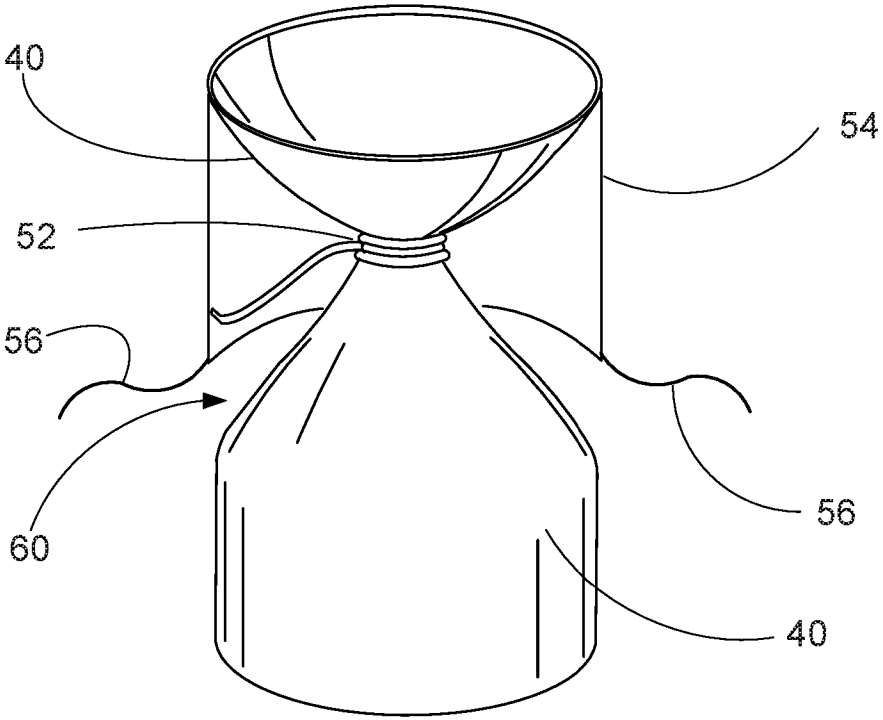
FIG. 2A is a view of an embodiment of a discharge assembly that can be used with a bulk bag having a lifting assembly in accordance with principles disclosed herein.
Figure 2:
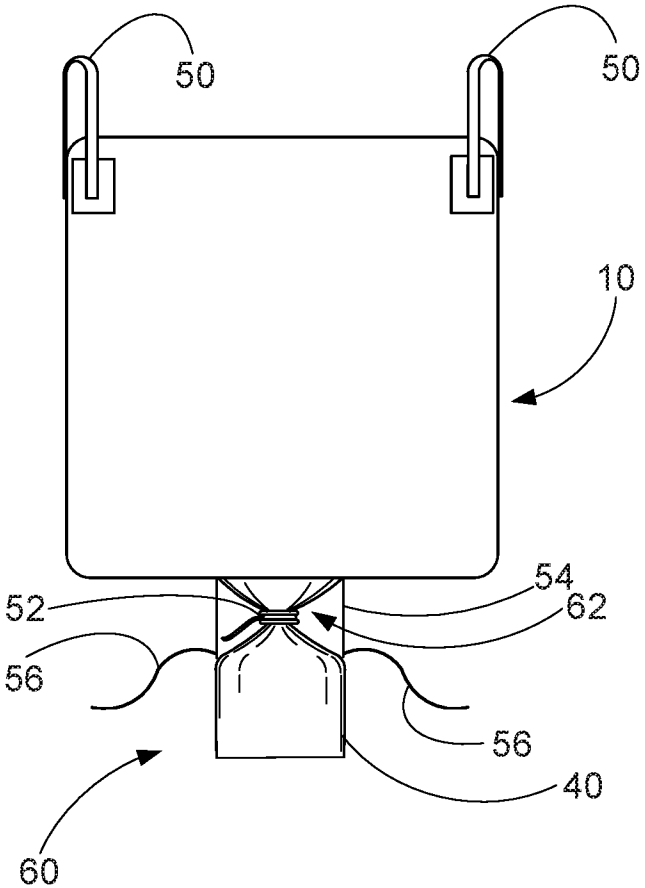
FIG. 2 is a schematic side view of an embodiment of a bulk bag including lift loops or straps in accordance with principles disclosed herein.

Referring now to FIGS. 2, 2A and FIGS. 3, 3A lift assemblies 205 are shown attached to bulk bags 10 that have different embodiments of discharge assemblies. FIGS. 2, 2A illustrate a bag with a discharge assembly 60. A discharge spout 40 is gathered, bunched and pinched at a pinch point 62. The fabric is generally pinched tightly enough to prevent passage of material at the pinch point 62. The pinch point 62 is then maintained by wrapping or tying a discharge spout tie 52 around the pinch point 62. An outer cover 54, which can be hand tied with a cover tie or cord 56, can be provided. In the embodiment as shown, when tying the cover 54 in place around the discharge tube 40, the tied off discharge tube 40 would be folded up against the bag. The figures show a cutaway view of the cover which includes a tie or cord 56, e.g., a drawstring tie, that can be pulled and tied off to effect closure of the cover over the discharge spout, e.g., after folded in half. The discharge cover as shown does not extend across an entire width of the bag bottom from one side to an opposing side. In the embodiment of discharge assembly 60 as described above, to change from a closed configuration to an open configuration during discharge, the knots in the tie 56 first must be untied while under pressure from the materials contained in the bag 10, or will need to be cut or otherwise removed. Knots in ties 52 will also need to be untied, while under pressure from the material contents of the bag. Such pressure, generally makes knots difficult to untie; the knots often tangle or do not slip open properly. If the knots do not untie properly, the operator must reach under the bag 10 with both hands to untie the knots. Due to the weight of the materials above the knots, the operator is quite often unable to untie the knots. Further, such an effort requires the operator to expose the operator's head, shoulders, and arms underneath the large volume of materials within the bag 10. The downward forces being applied by the operator to untie the knots increase the risk of unpredictable discharge, or the bag 10 dropping. If the operator cuts the knots to release the materials, then loose pieces of tie can fall into and mix with the materials, causing expensive contamination of the materials or damage to the conveying equipment. Alternatively, a cover 154 as described further below can also be used with the discharge assembly shown in FIGS. 2, 2A, instead of cover 54.

Figure 3A:
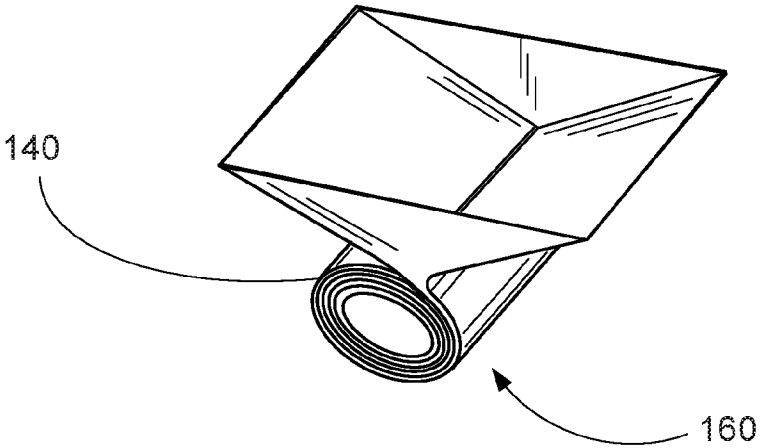
FIG. 3A is a view of another embodiment of a discharge assembly that can be used with a bulk bag having a lifting assembly in accordance with principles disclosed herein.
Figure 3:
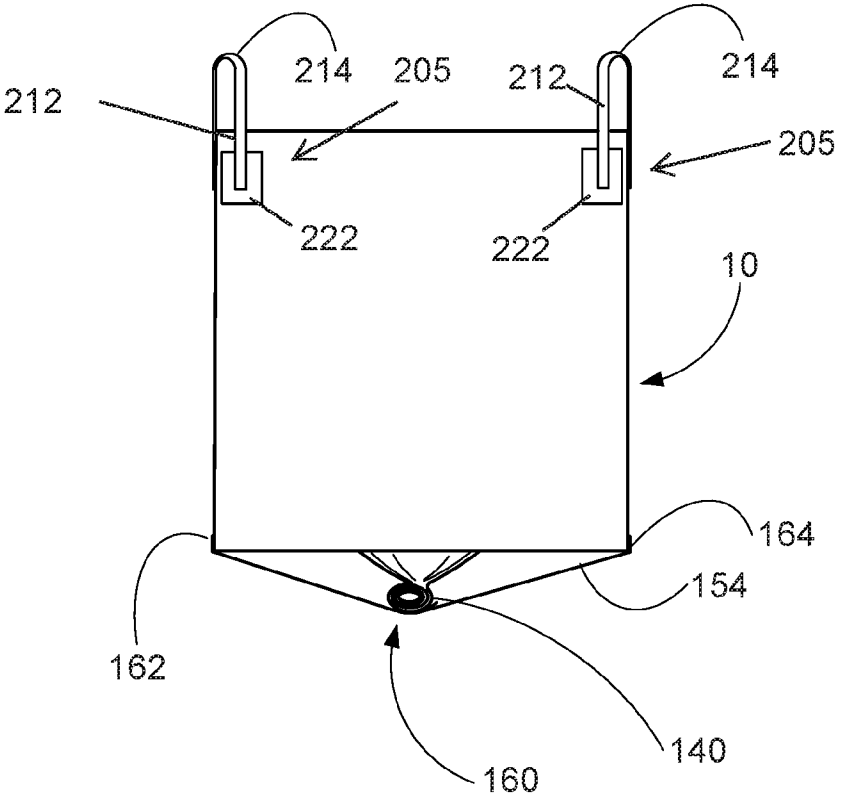
FIG. 3 is a schematic side view of an embodiment of a bulk bag including lift loops or straps in accordance with principles disclosed herein.

Referring now to FIGS. 3, 3A, a discharge assembly 160 is shown. Discharge assembly 160 on a bulk bag 10 eliminates problems associated with having to untie ties or knots on a cover and a discharge portion that is under pressure from material contents of the bag. Discharge assembly 160 preferably includes a discharge spout 40 rolled into a rolled configuration to define a rolled spout 140, and a releasable discharge spout coupler 152, which can be a tie or tape, e.g., fabric tape including an adhesive that preferably is not solvent based and wherein the adhesive remains active. Discharge spout coupler 152 will sometimes be referred to herein as tie or tape 152.

In some embodiments the discharge assembly 160 also includes a cover 154. Discharge spout 40 can be gathered or rolled toward the bottom of the bag 10. When rolled, the discharge spout 40 has a plurality of rolled layers 148 and forms a rolled discharge spout 140. To maintain a rolled position adjacent the bottom of the bag 10, a releasable discharge spout coupler 152 can be applied. In some embodiments, the discharge spout coupler 152 is an adhesive material, such as adhesive fabric tape, that can adhere to both rolled spout 140 and the bottom of the bag 10 to capture the rolled spout 140. Preferably the adhesive fabric tape is a polypropylene fabric with an adhesive that is not solvent based, and remains active. Other fabric tapes with an adhesive may also be used. The rolled spout 140 coupled to the bottom 39 provides a closed configuration of discharge tube 140, which prevents discharge of materials from the bag. The rolled layers can also help prevent unwanted sifting of materials from the bag.

In some embodiments a cover 154 is included as part of discharge assembly 160 and preferably is disposed across the rolled spout 140 that is coupled to the bottom 39 of the bag via tie or tape 152. Cover 154 can be attached to the bag 10 at couplings 162, 164. Couplings 162, 164 can attach the cover 154 at two sides of body, e.g. at two opposing sides. Preferably cover 154 is releasably attached to the bag 10. In some embodiments, the couplings 162, 164 include adhesives, while in other embodiments the couplings 162, 164 include heat fusion. In some embodiments, the pressure from the cover 154 helps maintain the rolled and tied spout 140 in position.

For discharge, if a cover 154 is part of discharge assembly 160, the cover 154 is first released from the bag. In some embodiments cover 154 can be released by peeling or detaching one or both couplings 162, 164. The rolled spout 140 can then be released by peeling or detaching the tie or tape 152 coupled across the spout 140. In this manner, an operator's hand is away from any material flow. An operator preferably can access both the cover 154 and the tie or tape 152 while positioned beside the bag and not standing under the bag. As the tie 152 is peeled or detached, the rolled layers 148 of rolled spout 140 automatically unrolls wherein materials flow easily from the bag 10. Preferably peeling or detaching tie 152 causes the rolled layers 148 to unroll and changes the closed configuration of the discharge tube to an open configuration. Preferably no knots are used in the discharge assembly 160, thus no knots need to be untied. Consequently, the discharge assembly 160 of the bag 10 can also be called knot-free.

Reference is made to co-pending U.S. patent application Ser. No. 15/345,452, filed on 7 Nov. 2016, which is hereby incorporated herein by reference, for further details on discharge assemblies 60, 160, and a cover 154.

It should be understood that a lifting assembly 205, including a lift loop assembly 210 and bag connection assembly 220, can be used with any bulk bag disclosed herein or with various types of prior art bulk bags or bulk bags to be developed in the future.

Figure 12:
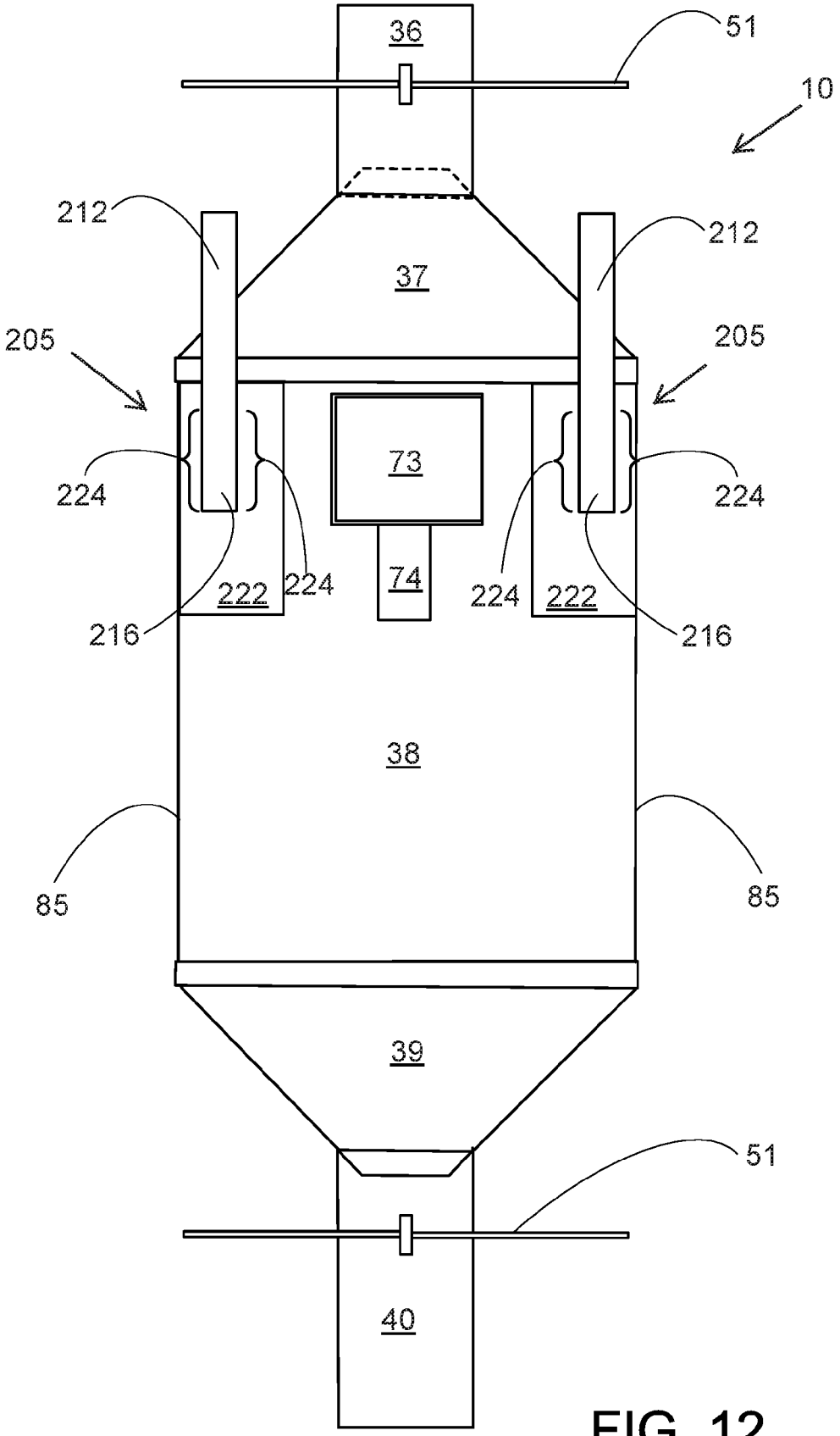
FIG. 12 is a top view of bulk bag in a substantially flat, folded configuration, including lifting assemblies and a document pouch in accordance with principles disclosed herein.
Figure 13:
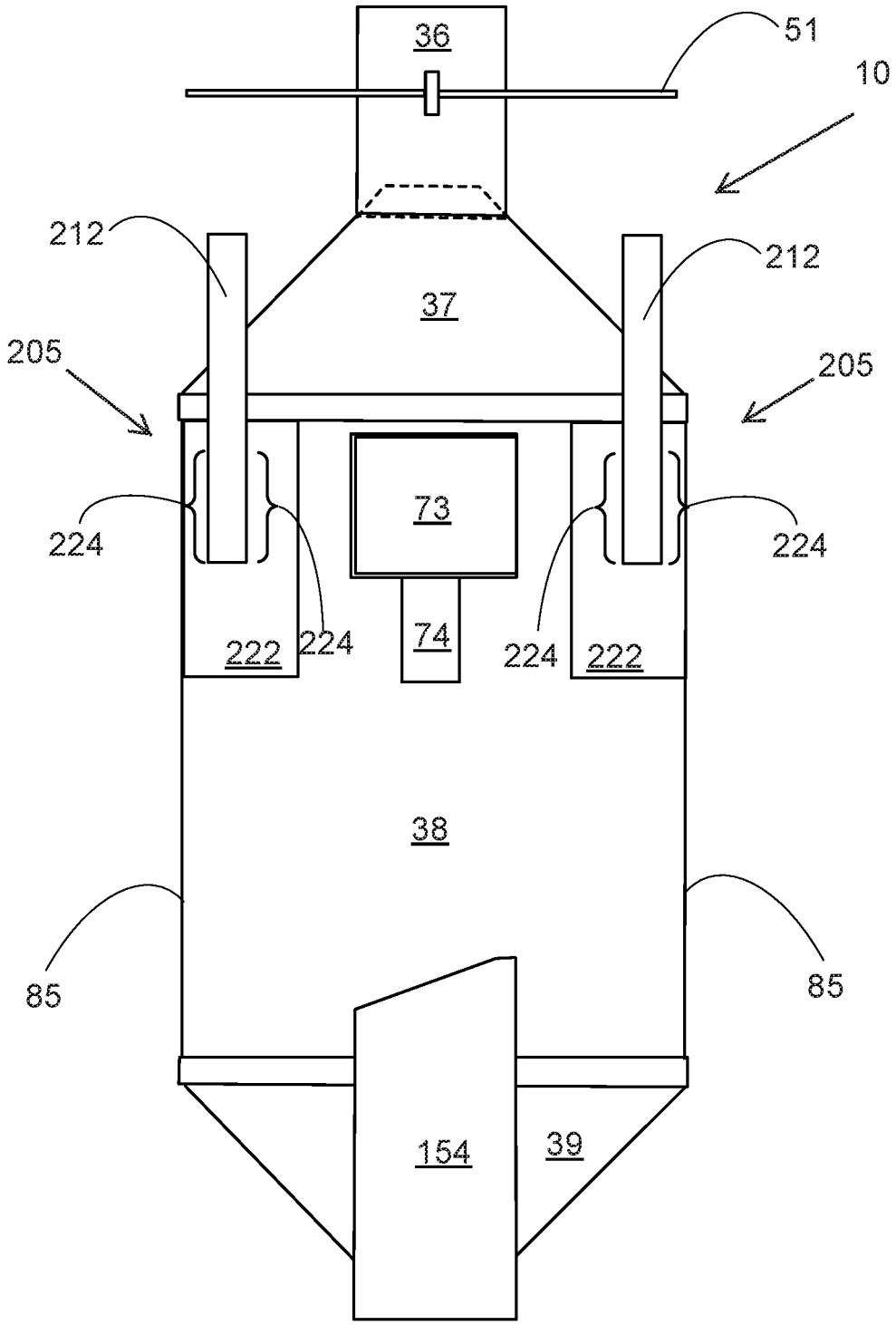
FIG. 13 is a top view of bulk bag in a substantially flat, folded configuration, including lifting assemblies and a discharge cover in accordance with principles disclosed herein.
Figure 14D:
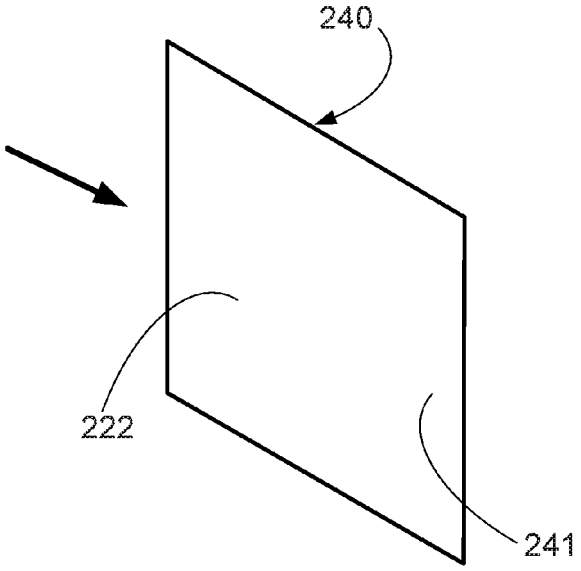
FIGS. 14C-14D are views of a patch or intermediate panel of a lifting assembly in accordance with principles disclosed herein.
Figure 14B:
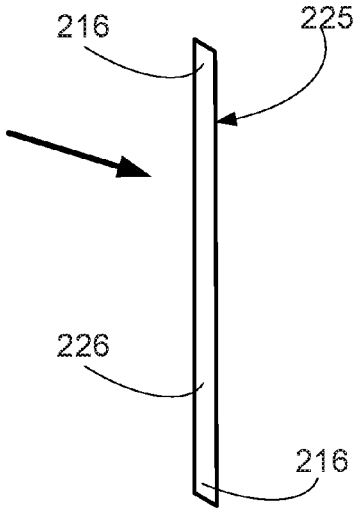
FIGS. 14A-14B are views of a lift loop or strap of a lift loop assembly in accordance with principles disclosed herein.
Figure 14C:
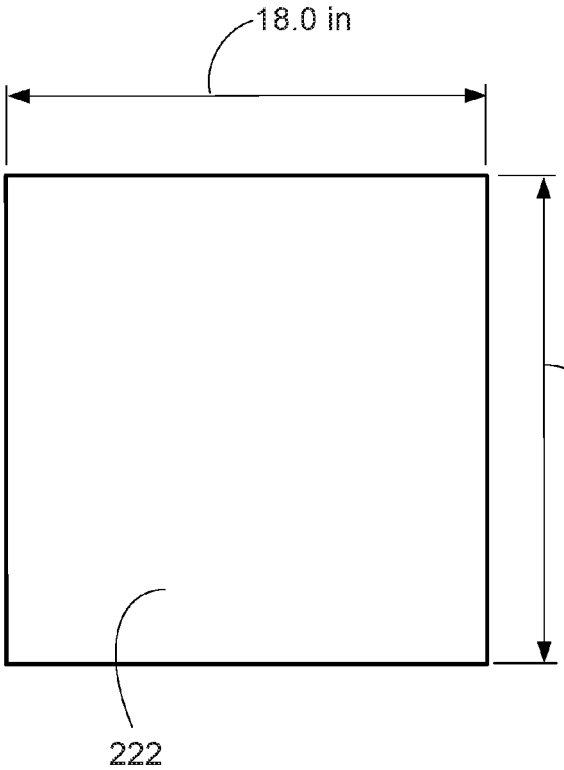
Figure 14A:
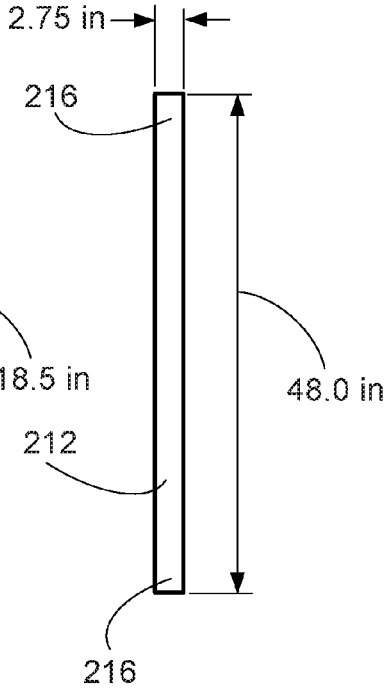

Referring to FIGS. 12, 13, in various embodiments a cover/document pouch impulse heat sealer can be used to also couple a pouch 73 and/or label or warning 74 to a bag 10. Label or warning 74 can be sealed with just an upper portion fitted under pouch 73 with the rest of warning 74 not connected to the bag. Pouch 73 can have fusion coating 191 on a bottom surface and can be heat sealed to exterior surface 44 of intermediate panel 38 which preferably has standard coating 19 thereon. As previously discussed, alternatively both a bottom surface of pouch 73 and exterior surface 44 of bag 10 can have a fusion coating 191, or a bottom surface of pouch 73 can have a standard coating 19, and exterior surface 44 of intermediate portion 38 can have a fusion coating 191.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims, that scope including all equivalents of the subject matter of the claims.

PARTS LIST

The following is a list of parts and materials suitable for use in the present invention:

| PART NO. | DESCRIPTION |
|---|---|
| 10 | bulk bag |
| 19 | coating/lamination |
| 36 | top spout |
| 37 | upper portion |
| 38 | intermediate portion |
| 39 | bottom portion |
| 40 | discharge spout |
| 41 | seam or joint |
| 43 | bag inner surface |
| 44 | bag outer surface |
| 50 | lift members/lift loops |
| 51 | upper lift end |
| 52 | discharge spout tie |
| 53 | lower connection end |
| 54 | outer cover |
| 55 | connection point |
| 56 | cover tie/cord |
| 60 | discharge assembly |
| 62 | pinch point |
| 73 | pouch |
| 74 | label/warning |
| 85 | fold |
| 93 | center position |
| 140 | rolled discharge spout |
| 146 | gussets |
| 152 | discharge spout coupler/tie |
| 154 | cover |
| 155 | connection points |
| 160 | discharge assembly |
| 162 | couplings |
| 164 | couplings |
| 191 | fusion/heat sealing coating |
| 205 | lifting assembly |
| 210 | lift loop/lift member assembly |
| 212 | lift strap |
| 214 | upper or lift end |
| 216 | lower or connection end |
| 220 | bag connection assemblies |
| 222 | patch/intermediate member |
| 224 | connection |
| 225 | loop/lift member bottom surface |
| 226 | loop/lift member upper surface |
| 228 | twist/fold |
| 240 | patch bottom surface |
| 241 | patch top surface |
| 251 | sidewall |
| 252 | sidewall |
| 253 | sidewall |
| 254 | sidewall |
| 261 | corner area |
| 262 | corner area |
| 263 | corner area |
| 264 | corner area |
| 267 | top edge |
| 271 | surface |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the claims.

The invention claimed is:

1. A flexible bulk bag that can hold 500 to 5,000 pounds of bulk material, the bag made of woven fabric and comprising:

a side wall made of woven fabric; and a lift assembly, the lift assembly including a lift member coupled with a coupler to an intermediate layer that is made of woven fabric;

wherein the woven fabric of the intermediate layer is coupled to the woven fabric of the bag side wall with a heat seal coupler; and wherein a heat sealed bond between the woven fabric of the intermediate layer and the woven fabric of the bag has at least 90% of the original fabric strength; and wherein the heat seal bond extends above the coupler and between the coupler and an upper portion of the intermediate layer to a location that is at least 1 inch above the coupler to protect the heat seal bond from being put into a peel position if the flexible bulk bag is picked up by the lift member when the lift member is positioned in a direction other than upwards.

2. The flexible bag of claim 1 wherein the lift member is sewn to the intermediate layer and wherein the intermediate layer is not sewn to the bag side wall.

3. The flexible bag of claim 2 wherein an upper sewn connection of the lift member is at least 1 to 2 inches away from an upper edge of the intermediate layer.

4. The flexible bag of claim 3 wherein the sewn connection of the lift member is spaced 1 to 3 inches away from the upper edge of the intermediate layer.

5. The flexible bag of claim 1 wherein the lift assembly is coupled to the bag side wall without creating stitch holes or otherwise puncturing the bag side wall.

6. The flexible bag of claim 1 wherein the intermediate layer of fabric is coupled to the bag side wall with a heat seal coupler positioned between the intermediate layer of fabric and the bag wall fabric, and wherein the intermediate layer of fabric is coupled to the bag side wall by positioning the intermediate layer of fabric on the bag side wall at a desired location and applying heat to the intermediate layer of fabric to melt the heat seal coupler and form a bond that connects the intermediate layer of fabric and the bag side wall fabric, the bag having the following directly adjacent layers at the bond: (1) bag side wall woven fabric; (2) heat seal coupler; (3) intermediate layer woven fabric; and (4) lift member.

7. The flexible bag of claim 1 wherein the lift member is a first lift member and the intermediate layer is a first intermediate layer and wherein the lift assembly further includes a second lift member and a second intermediate layer, a third lift member and a third intermediate layer, and a fourth lift member and a fourth intermediate layer.

8. The flexible bag of claim 7 wherein the first lift member is sewn to the first intermediate layer, the second lift member is sewn to the second intermediate layer, the third lift member is sewn to the third intermediate layer, and the fourth lift member is sewn to the fourth intermediate layer, and wherein the first, second, third and fourth intermediate layers are not sewn to the bag side wall.

9. The flexible bag of claim 8 wherein each of the first, second, third and fourth lift members are sewn to the respective first, second, third and fourth intermediate layers at sewn connections that are spaced a distance away from an upper edge of the respective first, second, third and fourth intermediate layers.

10. The flexible bag of claim 9 wherein each of the first, second, third and fourth lift members are sewn to the respective first, second, third and fourth intermediate layers at least an inch from an edge of the respective first, second, third and fourth intermediate layers.

11. The flexible bag of claim 7 wherein the first, second, third and fourth intermediate layers of the lift assembly are directly coupled to the bag side wall with a heat seal coupler and without creation of stitch holes or puncturing the bag side wall.

12. The flexible bag of claim 11 wherein the bag is designed to be filled with contents, and the lift assembly can hold at least a weight of the contents of the bag when the bag is lifted by the lift members.

13. The flexible bag of claim 11 wherein the bag is designed to be filled with contents, and the lift assembly can hold at least two times a weight of the contents of the bag that the bag is designed to hold.

14. The flexible bag of claim 11 wherein the bag is designed to be filled with contents, and the lift assembly can hold at least three times a weight of the contents of the bag that the bag is designed to hold.

15. The flexible bag of claim 11 wherein the bag is designed to be filled with contents, and the lift assembly can hold at least four times a weight of the contents of the bag that the bag is designed to hold.

16. The flexible bag of claim 15 wherein the bag is designed to contain 500 to 1,000 pounds of bulk material.

17. The flexible bag of claim 15 wherein the bag is designed to contain 1,000 to 2,000 pounds of bulk material.

18. The flexible bag of claim 15 wherein the bag is designed to contain 2,000 to 3,000 pounds of bulk material.

19. The flexible bag of claim 15 wherein the bag is designed to contain 3,000 to 4,000 pounds of bulk material.

20. The flexible bag of claim 15 wherein the bag is designed to contain 4,000 to 5,000 pounds of bulk material.

21. The flexible bag of claim 11 wherein the bag is designed to be filled with contents, and the lift assembly can hold at least five times a weight of the contents of the bag that the bag is designed to hold.

22. The flexible bag of claim 21 wherein the bag is designed to contain 1,000 pounds of bulk material.

23. The flexible bag of claim 21 wherein the bag is designed to contain 2,000 pounds of bulk material.

24. The flexible bag of claim 21 wherein the bag is designed to contain 3,000 pounds of bulk material.

25. The flexible bag of claim 21 wherein the bag is designed to contain 4,000 pounds of bulk material.

26. The flexible bag of claim 21 wherein the bag is designed to contain 5,000 pounds of bulk material.

27. The flexible bag of claim 7 wherein the heat seal bond is a first heat seal bond and wherein a second heat seal bond couples the second intermediate layer to the bag side wall, a third heat seal bond couples the third intermediate layer to the bag side wall, and a fourth heat seal bond couples the fourth intermediate layer to the bag side wall.

28. The flexible bag of claim 1 wherein dimensions of the intermediate layer that is coupled to the side wall determines the amount of weight that the lift assembly can hold.

29. The flexible bag of claim 1 wherein the lift member is a lift loop having a first end and a second end, the first and second ends coupled to the intermediate layer a distance away from each other.

30. The flexible bag of claim 1 wherein the lift member is coupled to the intermediate layer in an arch configuration.

31. The flexible bag of claim 1 wherein the assembly is adapted so that if the heat seal coupler fails or releases from the bag, a containment area of the bag will not be torn or punctured or otherwise exposed.

32. The flexible bag of claim 1 further comprising more than one lift member and more than one intermediate layer, wherein a said lift member is coupled to a said intermediate layer.

33. The bag of claim 1 wherein the fabric layer is polypropylene woven fabric and the bag is made of polypropylene woven fabric.

34. The bag of claim 1 wherein the fabric layer is polyethylene woven fabric and the bag is made of polyethylene woven fabric.

35. A lift member assembly on a flexible bulk bag made of woven fabric that has a bag outer fabric surface, the bag of the type that can hold 500 to 5000 pounds, the lift member assembly comprising:

a lift member coupled with a coupler to a woven fabric layer that has a fabric layer fabric outer surface;

wherein the fabric layer fabric outer surface is coupled to the bag outer fabric surface without stitching, sewing or puncturing the bag outer fabric surface;

wherein the fabric layer is an intermediate layer between the lift member and the flexible bag;

wherein a heat seal bond formed by a heat seal coupler directly connects the bag outer fabric surface to the fabric layer fabric outer surface; and wherein the heat seal bond extends above the coupler and between the coupler and an upper portion of the fabric layer to a location that is at least 1 inch above the coupler to protect the heat seal bond from being put into a peel position if the bag is picked up by the lift member when the lift member is positioned in a direction other than upwards.

36. The assembly of claim 35 wherein the lift member is coupled to the fabric layer by sewing.

37. The assembly of claim 36 wherein the heat seal coupler includes a first heat sealing coating on the fabric layer outer fabric surface and a second heat sealing coating on the bag outer fabric surface, and wherein the fabric layer is coupled to the flexible bag by positioning the first heat sealing coating of the fabric layer so that it is in contact with the second heat sealing coating on the flexible bag, and applying heat and pressure to form the heat seal bond.

38. The assembly of claim 36 wherein the assembly comprises a second lift member coupled to a second fabric layer, and wherein when the second fabric layer is coupled to the bag, the second fabric layer is an intermediate layer between the second lift member and the bag.

39. The assembly of claim 38 wherein the assembly comprises a third lift member coupled to a third fabric layer, and wherein when the third fabric layer is coupled to the bag, the third fabric layer is an intermediate layer between the third lift member and the bag.

40. The assembly of claim 39 wherein the assembly comprises a fourth lift member coupled to a fourth fabric layer, and wherein when the fourth fabric layer is coupled to the bag, the fourth fabric layer is an intermediate layer between the fourth lift member and the bag.

41. The assembly of claim 40 wherein the lift member is a first lift member and the fabric layer is a first fabric layer, and wherein the first, second, third and fourth fabric layers each include at least a portion of the heat seal coupler.

42. The assembly of claim 41 wherein the first lift member is sewn to the first fabric layer, the second lift member is sewn to the second fabric layer, the third lift member is sewn to the third fabric layer, and the fourth lift member is sewn to the fourth fabric layer, and wherein the first, second, third and fourth fabric layers are each coupled to the bag by positioning each of the first, second, third and fourth fabric layers on the bag at desired locations on the bag outer fabric surface, and applying heat and pressure to the first, second, third, and fourth fabric layers to melt the heat seal coupler and form the heat seal bond between the first fabric layer and the bag and also to form heat seal bonds between the second, third and fourth fabric layers and the bag.

43. The assembly of claim 42 wherein the first, second, third and fourth fabric layers are coupled to the bag simultaneously.

44. The assembly of claim 42 wherein the first, second, third and fourth fabric layers are not coupled to the bag simultaneously.

45. The assembly of claim 42 wherein the bag is designed to be filled with contents, and the assembly can hold a weight of the contents of the bag when the bag is lifted by the lift members.

46. The assembly of claim 42 wherein the bag is designed to be filled with contents, and the assembly can hold at least two times a weight of the contents that the bag is designed to hold.

47. The assembly of claim 42 wherein the bag is designed to be filled with contents, and the assembly can hold at least three times a weight of the contents that the bag is designed to hold.

48. The assembly of claim 42 wherein the bag is designed to be filled with contents, and the assembly can hold at least four times a weight of the contents that the bag is designed to hold.

49. The assembly of claim 42 wherein the bag is designed to be filled with contents, and the assembly can hold at least five times a weight of the contents that the bag is designed to hold.

50. The lift assembly of claim 35 wherein the lift member is a lift loop having a first end and a second end, the first and second ends coupled to the intermediate layer a distance away from each other.

51. The assembly of claim 35 wherein the lift member is coupled to the intermediate layer at least 2 inches below an upper edge of the intermediate layer.

52. The assembly of claim 35 wherein the lift member is coupled to the intermediate layer in an arch configuration.

53. The assembly of claim 35 wherein the assembly is adapted so that if the heat seal coupler fails or releases from the bag, a containment area of the bag will not be torn or punctured or otherwise exposed.

54. The assembly of claim 35 wherein the lift member has first and second ends and a top and bottom surface, and wherein prior to coupling the lift member to the fabric layer, the lift member is folded over or twisted at a location between the first and second ends and wherein the first and second lift member ends are coupled to the fabric layer after folding or twisting the lift member so that a bottom surface of the first end is in contact with the fabric layer and a top surface of the second end is in contact with the fabric layer.

55. The assembly of claim 35 wherein the fabric layer is polypropylene woven fabric and the bag is made of polypropylene woven fabric.

56. The assembly of claim 35 wherein the fabric layer is polyethylene woven fabric and the bag is made of polyethylene woven fabric.

57. A flexible woven fabric bulk bag of the type that can hold 500 to 5,000 pounds of bulk material, the bag comprising:

a body side wall made of woven polypropylene fabric;

a lift assembly including a fabric patch made of woven polypropylene fabric that is heat sealed to the body side wall with a heat seal coupler and without sewing, and a lift loop sewn to the patch at a sewn connection such that the lift loop is not sewn to the body side wall; and wherein the heat seal coupler directly connects the woven polypropylene fabric of the patch to the woven polypropylene fabric of the body side wall; and wherein the heat seal coupler extends above the sewn connection of the lift loop and between the sewn connection and an upper portion of the patch to a location that is at least 1 inch above the sewn connection.

58. A flexible woven fabric bulk bag of the type that can hold 500 to 5,000 pounds of bulk material, the bag comprising:

a body including a side wall having a body outer polypropylene fabric surface; and a lift loop assembly comprising a lift loop sewn to a polypropylene fabric patch at a sewn connection, the patch having a patch outer polypropylene fabric surface;

wherein the patch outer polypropylene fabric surface is heat sealed to the body outer polypropylene fabric surface such that the patch is an intermediate layer between the lift loop and the body side wall, and wherein a heat seal coupler directly bonds the body outer polypropylene fabric surface to the patch outer polypropylene fabric surface at a heat seal bond; and wherein the heat seal bond extends above the sewn connection and between the sewn connection and an upper portion of the patch to a location that is at least 1 inch above the sewn connection to protect the heat seal bond from being put into a peel position if the bag is picked up by the lift loop when the lift loop is positioned in a direction other than upwards.

* * * * *